US007639958B2

(12) United States Patent
Okamoto et al.

(10) Patent No.: US 7,639,958 B2
(45) Date of Patent: Dec. 29, 2009

(54) IMAGE FORMING APPARATUS AND CONTROL METHOD THEREFOR

(75) Inventors: Kiyoshi Okamoto, Moriya (JP); Akihiko Sakai, Abiko (JP); Shinichi Takata, Abiko (JP); Yuichiro Maeda, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 11/860,896

(22) Filed: Sep. 25, 2007

(65) Prior Publication Data

US 2008/0075496 A1 Mar. 27, 2008

(30) Foreign Application Priority Data

Sep. 26, 2006 (JP) ..... 2006-261416

(51) Int. Cl.
*G03G 21/14* (2006.01)

(52) U.S. Cl. ..... 399/38; 399/46; 399/49; 399/82; 399/34; 399/35; 399/27; 399/29; 399/257; 399/77

(58) Field of Classification Search ..... 399/38, 399/46, 49, 82, 34, 35, 27, 29, 157, 77, 257
See application file for complete search history.

(56) References Cited

U.S. PATENT DOCUMENTS

| | | | | |
|---|---|---|---|---|
| 6,384,934 | B1 | 5/2002 | Kohtani et al. | |
| 2004/0155952 | A1 | 8/2004 | Sato et al. | |
| 2005/0063721 | A1 * | 3/2005 | Nakayama et al. | 399/49 |
| 2007/0048025 | A1 * | 3/2007 | Suzuki | 399/257 |
| 2008/0075486 | A1 * | 3/2008 | Takahashi et al. | 399/43 |

FOREIGN PATENT DOCUMENTS

| | | | |
|---|---|---|---|
| JP | 10-243235 | A | 9/1998 |
| JP | 2004-122588 | A | 4/2004 |

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

This invention provides an image forming apparatus capable of shortening the user's print waiting time as much as possible when it is determined that image adjustment is necessary during the image forming operation, and a control method therefor. To accomplish this, in a color image forming apparatus including a plurality of image forming stations which form toner images with a plurality of toners on the basis of a job, it is discriminated whether adjustment processing is necessary during a continuous image forming operation based on the job. If it is discriminated that adjustment processing is necessary, it is determined whether each of the image forming stations has a non-operating time enough to execute the discriminated adjustment processing during the image forming operation. The image forming station determined to have a non-operating time enough to execute adjustment processing executes the discriminated adjustment processing during the non-operating time.

4 Claims, 21 Drawing Sheets

FIG. 2B

ROM/RAM CONFIGURATION

| | |
|---|---|
| SYSTEM PROGRAM (OS) | 301 |
| IMAGE FORMATION CONTROL PROGRAM | 302 |
| VARIOUS ADJUSTMENT PROCESSING PROGRAMS<br>(E.G., PATCH DETECTION PROCESSING AND PRIMARY TRANSFER ATVC) | 303 |
| DENSITY ADJUSTMENT TIME (PATCH DETECTION PROCESSING TIME)<br>TRANSFER VOLTAGE ADJUSTMENT TIME (PRIMARY TRANSFER ATVC PROCESSING TIME)<br>⋮ | 304 |
| IMAGE FORMING TIME OF ONE PAGE,<br>AND MOVING TIME BETWEEN IMAGES | 305 |
| ITEMS REQUIRING ADJUSTMENT PROCESSING DURING JOB OUTPUT,<br>AND TOTAL ADJUSTMENT TIME OF SELECTED ADJUSTMENT ITEMS | 306 |
| INPUT IMAGE DATA<br>JOB INFORMATION (NUMBER OF IMAGES AND SIZE) | 307 |
| OUTPUT IMAGE DATA (YMCK)<br>FIRST PAGE ·····<br>SECOND PAGE ·····<br>····· | 308 |
| COLOR INFORMATION USED FOR EACH IMAGE FORMATION (FIG. 3C) | 309 |
| RESULT OF EXTRACTING DEVELOPING MATERIAL<br>NOT USED FOR EACH IMAGE FORMATION (FIG. 3D) | 310 |
| IMAGE FORMATION STOP TIME OF<br>EACH IMAGE FORMING STATION (FIG. 3E) | 311 |
| RESULT OF SCHEDULING ADJUSTMENT PROCESSING<br>ITEMS DURING IMAGE FORMATION STOP TIME OF<br>EACH IMAGE FORMING STATION (FIGS. 5B AND 6B) | 312 |
| PROGRAM LOAD AREA | 313 |
| ⋮ | |

FIG. 3C

| COLOR INFORMATION USED FOR IMAGE FORMATION | |
|---|---|
| FIRST PAGE | Y, M, C, K |
| SECOND PAGE | K |
| THIRD PAGE | Y, M, , K |
| FOURTH PAGE | K |
| FIFTH PAGE | Y, M, C, K |

FIG. 3D

310

| RESULT OF EXTRACTING DEVELOPING MATERIAL NOT USED FOR EACH IMAGE FORMATION | | | | | |
|---|---|---|---|---|---|
| DEVELOPING MATERIAL | FIRST PAGE | SECOND PAGE | THIRD PAGE | FOURTH PAGE | FIFTH PAGE |
| Y (YELLOW) | ○ | × | ○ | × | ○ |
| M (MAGENTA) | ○ | × | ○ | × | ○ |
| C (CYAN) | ○ | × | × | × | ○ |
| K (BLACK) | ○ | ○ | ○ | ○ | ○ |

FIG. 3E

| | NON-OPERATING TIME (IMAGE FORMATION STOP TIME) OF EACH IMAGE FORMING STATION | NUMBER OF STOPS | REFERENCE PAGE FOR STOP | STOP TIME | ADJUSTMENT ITEM |
|---|---|---|---|---|---|
| | Ty(YELLOW) | | | | |
| 320 | Ty stop(1) | 1 | 1 | T1 | |
| 321 | Ty stop(2) | 2 | 3 | T1 | |
| | Tm (MAGENTA) | | | | |
| 322 | Tm stop(1) | 1 | 1 | T2 | |
| 323 | Tm stop(2) | 2 | 3 | T2 | |
| | Tc (CYAN) | | | | |
| 324 | Tc stop(1) | 1 | 1 | T3 | |
| | Tk(BLACK) | | | | |
| | Tk stop(0) | 0 | | | |

FIG. 5B

| NON-OPERATING TIME (IMAGE FORMATION STOP TIME) OF EACH IMAGE FORMING STATION | NUMBER OF STOPS | REFERENCE PAGE FOR STOP | STOP TIME | ADJUSTMENT ITEM |
|---|---|---|---|---|
| Ty (YELLOW) | – | – | – | – |
| Ty stop(1) | 1 | 1 | T1 | NONE |
| Ty stop(2) | 2 | 3 | T1 | NONE |
| Tm (MAGENTA) | – | – | – | – |
| Tm stop(1) | 1 | 1 | T2 | NONE |
| Tm stop(2) | 2 | 3 | T2 | NONE |
| Tc (CYAN) | – | – | – | – |
| Tc stop(1) | 1 | 1 | T3 | DENSITY ADJUSTMENT (ADJ1) |
| Tk (BLACK) | – | – | – | – |
| Tk stop(0) | 0 | | | NONE |

FIG. 6B

| NON-OPERATING TIME (IMAGE FORMATION STOP TIME) OF EACH IMAGE FORMING STATION | NUMBER OF STOPS | REFERENCE PAGE FOR STOP | STOP TIME | ADJUSTMENT ITEM |
|---|---|---|---|---|
| Ty (YELLOW) | – | – | – | – |
| Ty stop(1) | 1 | 1 | T1 | NONE |
| Ty stop(2) | 2 | 3 | T1 | NONE |
| Tm (MAGENTA) | – | – | – | – |
| Tm stop(1) | 1 | 1 | T2 | DENSITY ADJUSTMENT (ADJ2) |
| Tm stop(2) | 2 | 3 | T2 | TRANSFER ADJUSTMENT (ADJ3) |
| Tc (CYAN) | – | – | – | – |
| Tc stop(1) | 1 | 1 | T3 | DENSITY ADJUSTMENT (ADJ2) + DEVELOPING MATERIAL DISCHARGE ADJUSTMENT (ADJ3) |
| Tk (BLACK) | – | – | – | – |
| Tk stop(0) | 0 | – | – | NONE |

IMAGE FORMING APPARATUS AND CONTROL METHOD THEREFOR

BACKGROUND OF THE INVENTION

1. Field of the Invention

The present invention relates to an image forming apparatus employing electrophotographic printing or electrostatic printing and a control method therefor and, more particularly, to image adjustment control of a color image forming apparatus.

2. Description of the Related Art

Conventional color image forming apparatuses, especially tandem type (e.g., 4D type) image forming apparatuses cannot prevent gradual changes in output image density and density balance as the number of output sheets increases or the environment changes.

To prevent the foregoing problems, a variety of adjustment processes have been proposed. For example, various proposals are made in association with automatic maintenance processing or adjustment processing executed automatically during the image forming operation (e.g., Japanese Patent Laid-Open No. 10-243235). For example, there is proposed an image forming apparatus having a means for determining the necessity to adjust image forming conditions during the image forming operation, and a means for adjusting the image forming conditions. In this image forming apparatus, when it is determined that adjustment is necessary, adjustment of the image forming conditions is suspended until the end of image formation in process.

According to this technique, when it is determined that image adjustment processing is necessary, adjustment is suspended until the end of an image forming job in process. After the job ends, image adjustment processing must be done. Image adjustment processing always requires a down time after the end of a job. When jobs are successively performed, the user must wait a long time for a printout.

SUMMARY OF THE INVENTION

The present invention enables realization of an image forming apparatus capable of shortening the user's printout waiting time as much as possible when it is determined that image adjustment is necessary during the image forming operation, and a control method therefor.

An aspect of the present invention provides an image forming apparatus including a plurality of image forming stations which form toner images on a sheet on the basis of a job for forming an image, the apparatus comprising: a discrimination unit adapted to discriminate whether a condition to perform adjustment processing for parameters of the image forming stations during an image forming operation of a plurality of pages based on the job is satisfied; a determination unit adapted to, in a case where the discrimination unit discriminates that the condition to perform adjustment processing is satisfied, determine whether at least one of the image forming stations has a non-operating time period long enough to execute adjustment processing satisfying the condition during the image forming operation of the plurality of pages; and a control unit adapted to perform the adjustment processing to the image forming station having the non-operating time during the non-operating time period.

Another aspect of the present invention provides an image forming apparatus including a plurality of image forming stations which form toner images on a sheet on the basis of a job for forming an image, the apparatus comprising: a discrimination unit adapted to discriminate whether a condition to discharge toner accumulated in charging units or developing units of the image forming stations during an image forming operation of a plurality of pages based on the job is satisfied; a determination unit adapted to, when the discrimination unit discriminates that the condition to perform a toner discharge operation is satisfied, determine whether at least one of the image forming stations has a non-operating time enough to execute the toner discharge operation during the image forming operation of the plurality of pages; and a control unit adapted to perform the toner discharge operation to the image forming station having the non-operating time during the non-operating time.

Further features of the present invention will be apparent from the following description of exemplary embodiments with reference to the attached drawings.

BRIEF DESCRIPTION OF THE DRAWINGS

FIG. 2B is a view showing a ROM/RAM structure of the color image forming apparatus according to the first embodiment;

FIG. 3C is a table for explaining color information used for image formation;

FIG. 3D is a table for explaining the result of extracting a toner not used for each image formation;

FIG. 3E is a table for explaining the image formation stop time (non-operating time) of each image forming station, the number of stops, the reference page for the image formation stop, and the stop time;

FIG. 5B is a table showing an example of storing the schedule of (one) adjustment processing in FIG. 5A in a RAM;

FIG. 6B is a table showing an example of storing the schedule of (one or two) adjustment processes in FIG. 6A in the RAM;

DESCRIPTION OF THE EMBODIMENTS

A preferred embodiment of the present invention will now be described in detail with reference to the drawings. It should be noted that the relative arrangement of the components, the numerical expressions and numerical values set forth in these embodiments do not limit the scope of the present invention unless it is specifically stated otherwise.

[Features]

A color image forming apparatus according to a first embodiment of the invention can shorten the user's print waiting time when it is determined that adjustment processing is necessary during an image forming operation to successively form images on the basis of an image forming job. Adjustment processing is executed to adjust parameters concerning image formation because the output image density and density balance of a color image forming apparatus gradually change as the number of output sheets increases or the environment changes. The adjustment processing is executed when a predetermined amount of time has elapsed after previous adjustment processing or the number of images formed after previous adjustment processing exceeds a predetermined value. Image forming parameters are, e.g., the toner supply amount and transfer voltage. Image forming parameters are calculated and corrected by, e.g., patch detection processing to provide a stable toner density.

The operation of the image forming apparatus will now be described. The image forming apparatus comprises a plurality of image forming stations for forming toner images with different toners on the basis of the requirements of a job. It is determined whether to perform adjustment processing during a continuous image forming operation based on a job. If it is determined that adjustment processing is necessary, an image forming station having a non-operating time period long enough to execute the adjustment processing during image formation is selected from the image forming stations. The order of image adjustment processes performed during the image forming operation can also be scheduled separately for the selected image forming station. In this manner, the image forming station can select an image forming station not used for image formation during the image forming operation. By using the non-operating time of each selected image forming station, the image forming apparatus can perform adjustment processing of the selected image forming station in parallel with image formation by other image forming stations. As a result, the image forming apparatus can shorten the down time of adjustment processing and improve usability. If an image forming station requiring adjustment processing does not have any non-operating time, the adjustment processing is performed after the end of an image forming job. FIGS. 2B to 6B show the features of the present invention.

The image forming apparatus according to the present invention will be explained in detail below with reference to the accompanying drawings.

Figure 1:
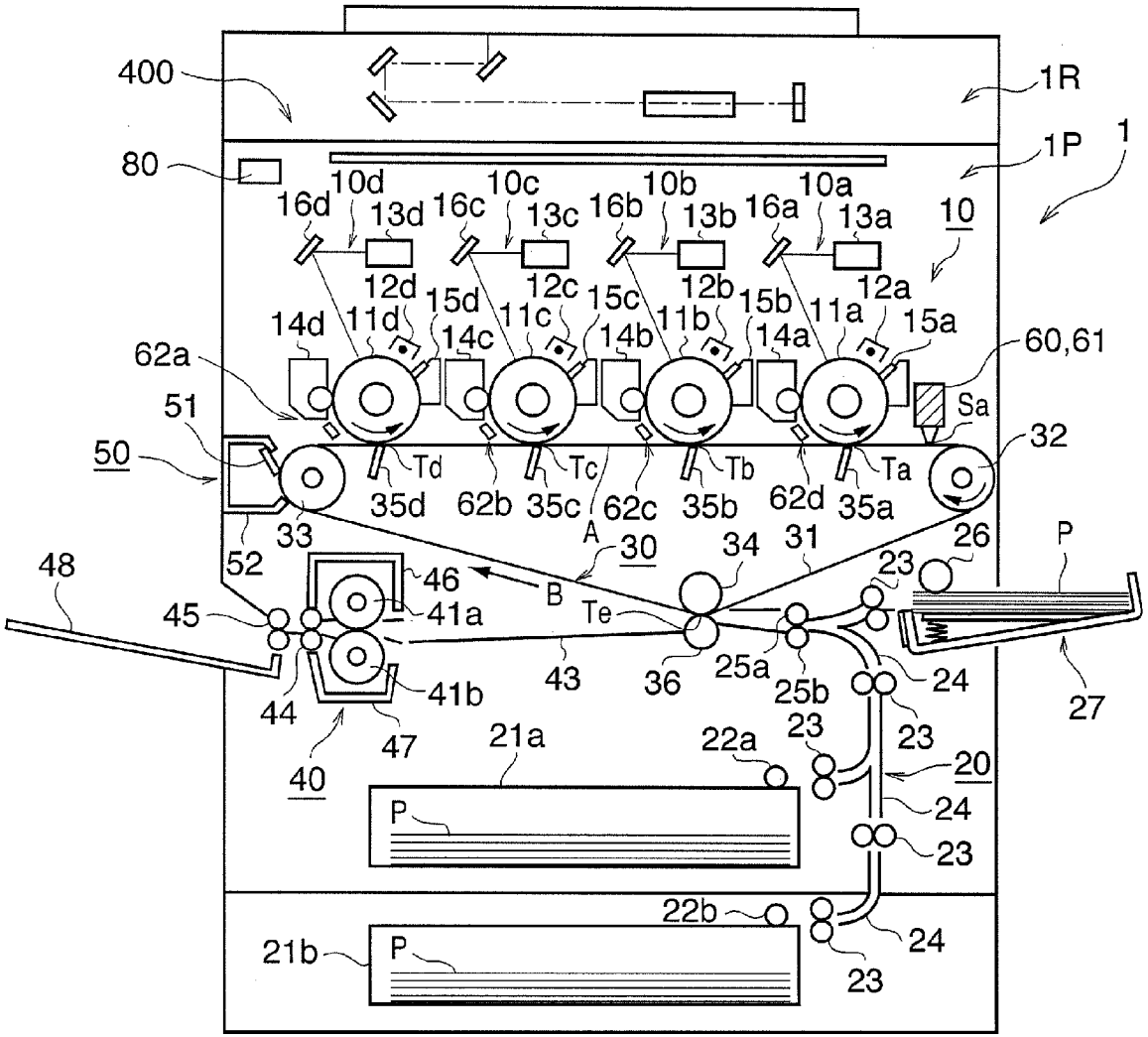
FIG. 1 is a schematic sectional view showing the overall structure of a color image forming apparatus according to a first embodiment of the invention.

[Image Forming Apparatus: FIG. 1]

FIG. 1 is a schematic sectional view showing the overall structure of an electrophotographic color image forming apparatus 1 according to the first embodiment of the invention.

The color image forming apparatus 1 according to the first embodiment comprises a plurality of image forming stations juxtaposed to each other, and employs an intermediate transfer scheme. The color image forming apparatus 1 comprises an image reading section 1R and an image output section 1P. The image reading section 1R optically reads a document image, converts it into an electrical signal, and transmits the signal to the image output section 1P. In the first embodiment, the image output section 1P comprises four juxtaposed image forming stations 10, i.e., 10*a*, 10*b*, 10*c*, and 10*d*, a paper feed unit 20, an intermediate Transfer unit 30, a fixing unit 40, a cleaning unit 50, and a control unit 80.

Each unit will now be described in detail.

The image forming stations 10*a*, 10*b*, 10*c*, and 10*d* have the same arrangement. In the image forming stations 10*a*, 10*b*, 10*c*, and 10*d*, photosensitive drums 11, i.e., 11*a*, 11*b*, 11*c*, and 11*d* serving as the first image carriers are rotatably supported by shafts, and driven to rotate in directions indicated by arrows. Primary chargers 12, i.e., 12*a*, 12*b*, 12*c*, and 12*d*, optical systems 13, i.e., 13*a*, 13*b*, 13*c*, and 13*d*, and reflecting mirrors 16, i.e., 16*a*, 16*b*, 16*c*, and 16*d* are arranged along the rotational directions of the photosensitive drums 11*a*, 11*b*, 11*c*, and 11*d* so as to face the outer surfaces of the corresponding photosensitive drums 11*a*, 11*b*, 11*c*, and 11*d*. Developing units 14, i.e., 14*a*, 14*b*, i4*c*, and 14*d*, and cleaning units 15, i.e., 15*a*, 15*b*, 15*c*, and 15*d* are also arranged. The photosensitive drums 11*a*, 11*b*, 11*c*, and 11*d* are freely spaced apart from or brought into contact with the intermediate transfer unit 30 using their rotating shafts as a reference by separation motors (not shown).

The primary chargers 12*a* to 12*d* apply a uniform amount of charges to the surfaces of the photosensitive drums 11*a* to 11*d*. The optical systems 13*a* to 13*d* form electrostatic latent images by exposing the surfaces of the photosensitive drums 11*a* to 11*d* via the reflecting mirrors 16*a* to 16*d* with light beams such as a laser beam modulated in accordance with printing image signals from the image reading section 1R serving as a printing image signal output section. The developing units 14*a* to 14*d* contain toners of yellow (Y), magenta (M), cyan (C), and black (K) colors, and visualize the electrostatic latent images.

In image transfer areas Ta, Tb, Tc, and Td, the visualized images are transferred onto an intermediate transfer belt 31 serving as the second image carrier which forms the intermediate transfer unit 30. The intermediate transfer unit 30 will be described in detail later.

The cleaning units 15*a*, 15*b*, 15*c*, and 15*d* arranged downstream of the image transfer areas Ta, Tb, Tc, and Td scrape toners which are not transferred onto the intermediate transfer member and remain on the photosensitive drums 11*a* to 11*d*. By the above-described process, images are sequentially formed with the toners.

The paper feed unit 20 comprises cassettes 21*a* and 21*b* and a manual feed tray 27 for storing transfer materials P, and pickup rollers 22*a*, 22*b*, and 26 for feeding the transfer materials P one by one from the cassettes 21*a* and 21*b* and manual feed tray 27. The paper feed unit 20 also comprises paper feed roller pairs 23 for further conveying the transfer material P picked up by each pickup roller, a paper feed guide 24, and registration rollers 25*a* and 25*b* for feeding the transfer material P to a secondary transfer area Te in synchronism with the image forming timing of each image forming unit.

The intermediate transfer unit 30 will now be described in detail.

The intermediate transfer belt 31 has a driving roller 32 which transmits a driving force to the intermediate transfer belt 31. The intermediate transfer belt 31 is looped between a driven roller 33 and a secondary transfer counter roller 34. The driven roller 33 serves as a tension roller which applies proper tension to the intermediate transfer belt 31 by the biasing force of a spring (not shown). The driven roller 33 is driven by circulation of the intermediate transfer belt 31. Primary transfer plane A is formed between the driving roller 32 and the driven roller 33. The intermediate transfer belt 31 is made from PET (polyethylene terephthalate), PVdF (polyvinylidene fluoride), or the like. The driving roller 32 is fabricated by coating the surface of a metal roller with rubber (urethane or chloroprene) several mm thick in order to prevent a slip between the driving roller 32 and the belt. A pulse motor (not shown) drives the driving roller 32 to rotate.

In the primary transfer areas Ta to Td where the photosensitive drums 11*a* to 11*d* face the intermediate transfer belt 31, primary transfer units 35, i.e., 35*a* to 35*d* are arranged below the intermediate transfer belt 31. A secondary transfer roller 36 is arranged to face the secondary transfer counter roller 34. A nip between the secondary transfer roller 36 and the intermediate transfer belt 31 forms the secondary transfer area Te. The secondary transfer roller 36 is pressed against the intermediate transfer belt 31 at a proper pressure.

The cleaning unit 50 for cleaning the image forming surface of the intermediate transfer belt 31 is arranged downstream of the secondary transfer area Te of the intermediate transfer belt 31. The cleaning unit 50 comprises a cleaning blade 51 for removing toner from the intermediate transfer belt 31, and a waste toner box 52 for storing waste toner.

The fixing unit 40 comprises a fixing roller 41*a* which incorporates a heat source such as a halogen heater, and a pressurizing roller 41*b* (which may also incorporate a heat source). The fixing unit 40 also comprises a guide 43 for guiding the transfer material P to a nip between the pair of rollers 41*a* and 41*b*, and fixing heat insulating covers 46 and 47 for confining heat of the fixing unit inside. Internal delivery rollers 44 and external delivery rollers 45 for guiding the discharged transfer material P outside the apparatus, and a delivery tray 48 for stacking the transfer material P are arranged downstream of the pair of rollers 41*a* and 41*b*.

Figure 2A:
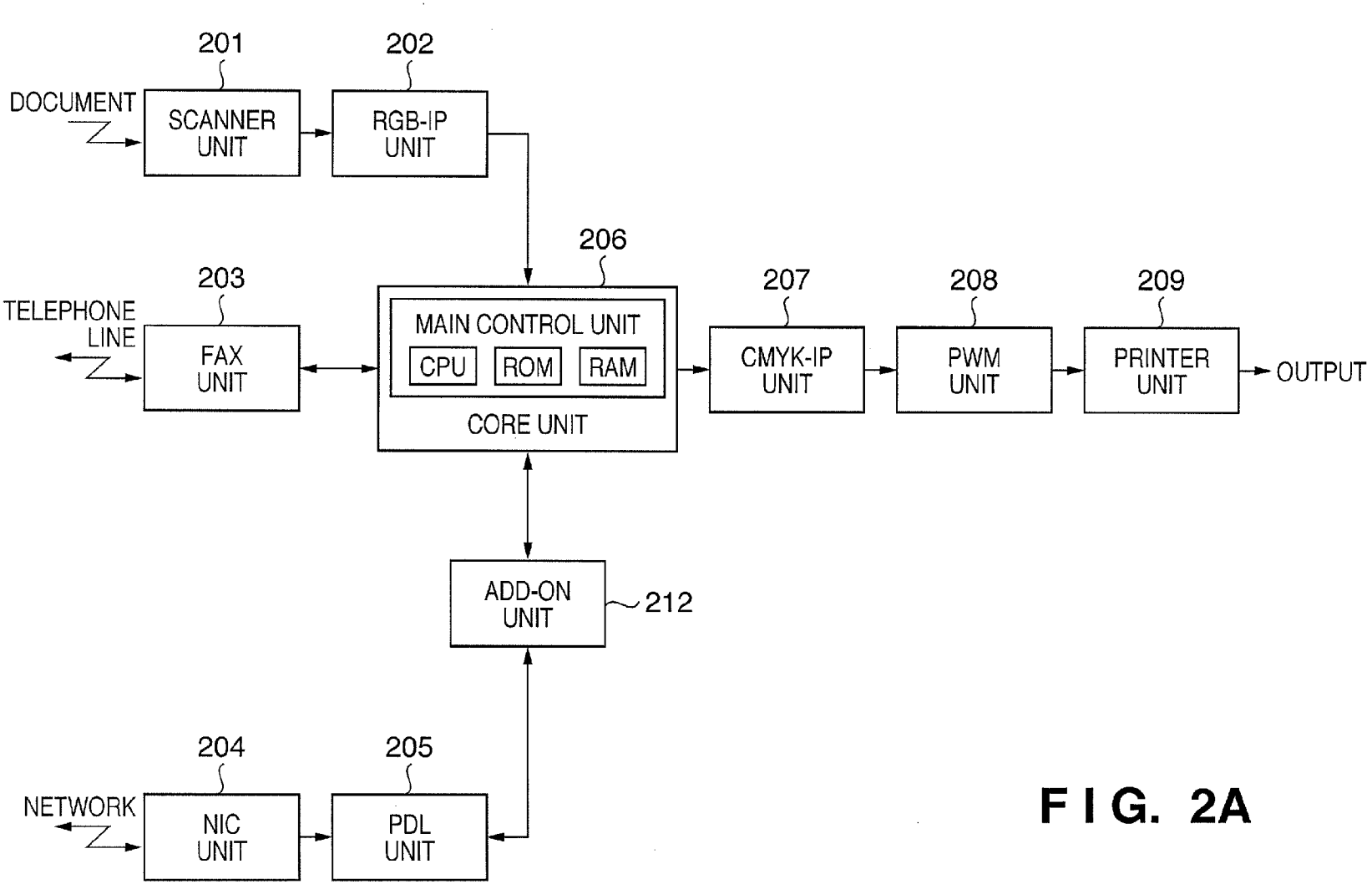
FIG. 2A is a block diagram of the control arrangement of the color image forming apparatus according to the first embodiment.

[Arrangement of Control Unit: FIG. 2A]

FIG. 2A is a block diagram of the control unit 80.

A scanner unit 201 in the image reading section 1R scans an image, and an RGB-IP unit 202 processes the image data. As typified by facsimile, a FAX unit 203 transmits/receives an image via a telephone line. A NIC (Network Interface Card) unit 204 exchanges image data and apparatus information using a network. A PDL unit 205 rasterizes a page description language (PDL) transmitted from a computer into an image signal. An add-on unit 212 is generally in a through state (in which it passes image data), and when adding add-on information, is enabled (state in which it performs add-on processing for image data). A core unit 206 temporarily saves an image signal or determines a path in accordance with the usage of the image forming apparatus. A main control unit 700 in the core unit 206 controls all modules. The CPU of the main control unit 700 can execute image forming processing shown in FIG. 4 (to be described later) and the like using the RAM as a work area on the basis of control programs stored in the ROM. Image data output from the core unit 206 is sent to a PWM unit 208 via a CMYK-IP unit 207, then sent to a printer unit 209 for forming an image, and printed out.

[ROM/RAM Structure: FIG. 2B]

A ROM/RAM structure of the main control unit 700 will be described with reference to FIG. 2B. FIG. 2B illustrates data associated with the present invention, and does not illustrate those irrelevant or less relevant to the present invention.

In the ROM, an area 301 stores a system program, an area 302 stores an image formation control program, and an area 303 stores various adjustment processing programs (e.g., patch detection processing, primary transfer ATVC (Auto Transfer Voltage Control) processing, toner discharge processing, and ATR (Auto Toner Regulation) processing). An area 304 stores the density adjustment time (patch detection processing time), the transfer voltage adjustment time (primary transfer ATVC processing time), and the toner discharge adjustment time. An area 305 stores the image forming time of one page corresponding to each image size (e.g., A4 or B4), and the moving time between images.

In the RAM, an area 306 stores adjustment items which are detected during output of an image forming job and require adjustment processing, and the total adjustment time of these adjustment items. An area 307 stores input image data and its job information (image type (e.g., RGB, YMC, or page description language), the number of images, and size). An area 308 stores output image data of each page which is created on the basis of input image data in the area 307 and uses Y, M, C, and K toners. An area 309 stores color information (see FIG. 3C) used to form each image created on the basis of output image data in the area 308. An area 310 stores the result (see FIG. 3D) of extracting a toner not used for each image formation. An area 311 stores the image formation stop time (non-operating time) (see FIG. 3E) of each image forming station. An area 312 stores the result (see FIGS. 5B and 6B) of scheduling adjustment items during the image formation stop time (non-operating time) of each image forming station. An area 313 is used as a program load area.

Figure 9:
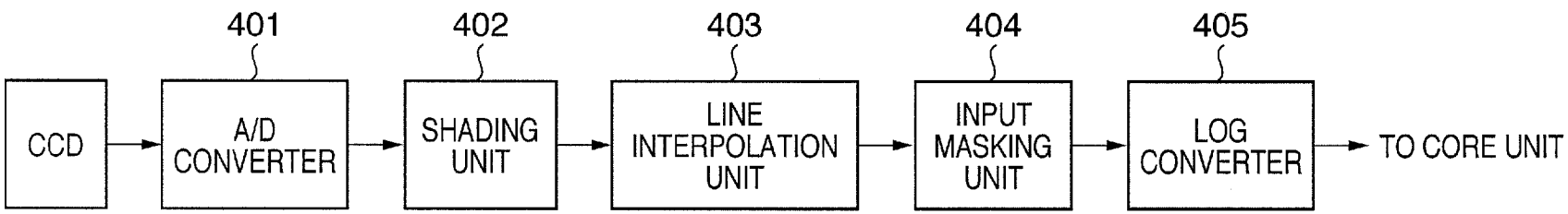
FIG. 9 is a block diagram for explaining details of a scanner unit and RGB-IP unit in FIG. 2.

[Arrangement of RGB-IP Unit: FIG. 9]

Details of the RGB-IP unit 202, FAX unit 203, NIC unit 204, PDL unit 205, core unit 206, CMYK-IP unit 207, and PWM unit 208 shown in FIG. 2A, and a paper feed operation will be explained with reference to FIGS. 9 to 13B.

The scanner unit 201 and RGB-IP unit 202 will be described with reference to FIG. 9.

A CCD sensor converts an input optical signal into an electrical signal. The CCD sensor is a color sensor of three R, G, and B lines, and outputs R, G, and B image signals to an A/D converter 401. After the CCD sensor adjusts the gain and offset, the A/D converter converts color signals into 8-bit digital image signals R0, G0, and B0. A shading unit 402 executes known shading correction for each color using the read signal of a reference white plate. A line interpolation unit 403.corrects a spatial shift in the subscanning direction. The spatial shift occurs because the color line sensors of the CCD sensor are laid out at predetermined distances.

An input masking unit 404 converts a read color space determined by the spectral characteristics of the R, G, and B filters of the CCD sensor into an NTSC standard color space. More specifically, the input masking unit 404 converts input signals R0, G0, and B0 into standard signals R, G, and B by executing 3×3 matrix calculation using a constant unique to the apparatus in consideration of characteristics such as the sensitivity characteristic of the CCD sensor and the spectral characteristic of the illumination lamp. A luminance/density converter (LOG converter) 405 is formed from a lookup table (LUT), and converts R, G, and B luminance signals into C1, M1, and Y1 density signals. When performing monochrome image processing, it is also possible to use a 1-line sensor for a single color, perform A/D conversion and shading for the single color, and then perform input/output masking, gamma conversion, and spatial filtering in the order named.

Figure 10:
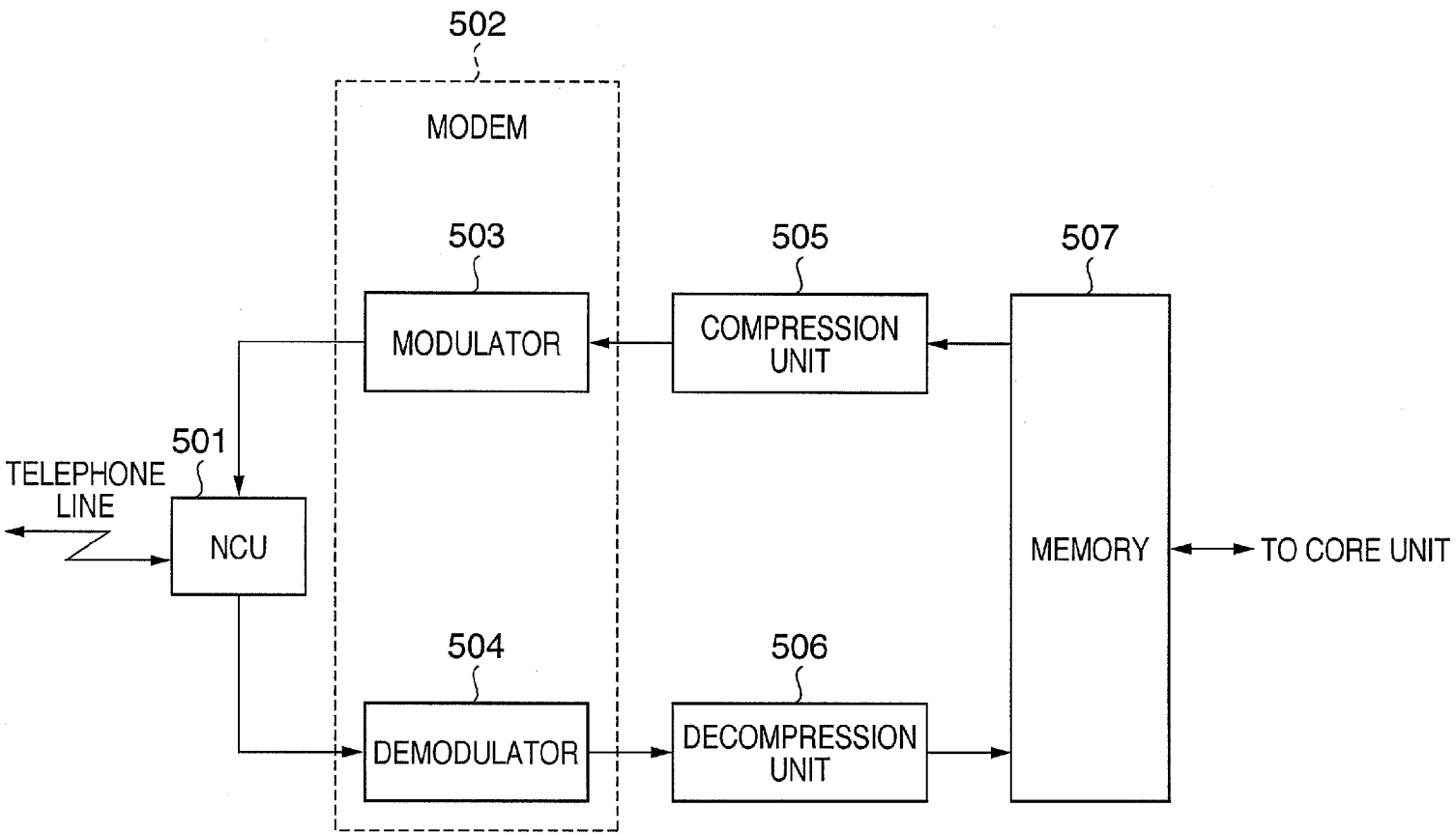
FIG. 10 is a block diagram for explaining details of a FAX unit in FIG. 2.

[Arrangement of FAX Unit: FIG. 10]

The FAX unit 203 will now be described with reference to FIG. 10.

In reception, an NCU unit 501 receives data from a telephone line and converts the voltage. A demodulator 504 in a modem 502 A/D-converts and demodulates the data. Then, a decompression unit 506 rasterizes the data into raster data. FAX compression/decompression generally uses a well-known run-length method, and a description thereof will be omitted. The image converted into raster data is temporarily stored in a memory 507, and after it is confirmed that the image data does not have any transfer error, sent to the core unit 206. In transmission, a compression unit 505 compresses, by the run-length method or the like, the image signal of a raster image transmitted from the core unit. A modulator 503 in the modem 502 D/A-converts and modulates the data. Then, the data is transmitted to the telephone line via the NCU unit 501.

Figure 11:
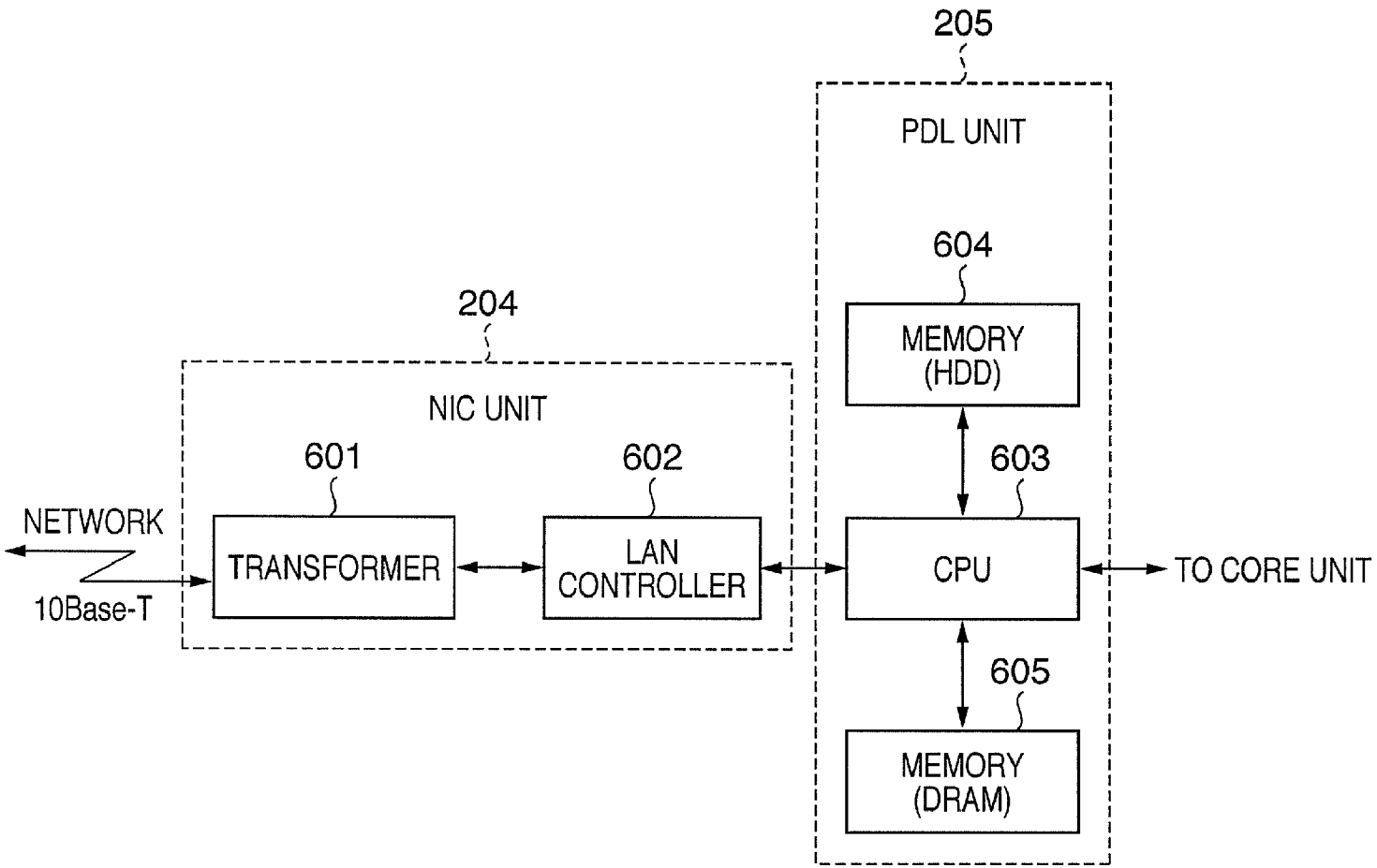
FIG. 11 is a block diagram for explaining details of a NIC unit and PDL unit in FIG. 2.

[Arrangement of NIC Unit: FIG. 11]

The NIC unit 204 will now be described with reference to FIG. 11.

The NIC unit 204 functions as an interface with a network, and has a function of acquiring external information via, e.g., an Ethernet® cable such as 10Base-T/100Base-TX, and supplying information outside. When external information is acquired, a transformer 601 converts the voltage to send the information to a LAN controller 602. The LAN controller 602 incorporates buffer memory 1 (not shown). After determining whether the information is necessary, the LAN controller 602 sends the information to buffer memory 2 (not shown), and supplies the signal to the PDL unit 205. When information is to be supplied outside, the LAN controller 602 adds the necessary information to data sent from the PDL unit 205. The resultant information is supplied to the network via the transformer 601.

[Arrangement of PDL Unit: FIG. 11]

The PDL unit 205 will now be described with reference to FIG. 11. Image data created by-application software running on a computer contains text, graphics, and photos, which are formed from combinations of image description elements such as text codes, graphic codes, and raster image data. Such image data is a so-called PDL (Page Description Language) typified by PostScript® available from Adobe.

FIG. 11 shows an arrangement of converting PDL data into raster image data. PDL data sent from the NIC unit 204 is temporarily stored via a CPU 603 in a large-capacity memory 604 such as a hard disk (HDD), where the PDL data is managed and saved for each job. If necessary, the CPU 603 executes RIP (Raster Image Processing) to rasterize the PDL data into a raster image. The raster image data of C, M, Y, and K color components of each page are stored for each job in a high-speed accessible memory 605 such as a DRAM. The raster image data is sent to the core unit 206 via the CPU 603 again in accordance with the status of the printer unit 209.

Figure 12:
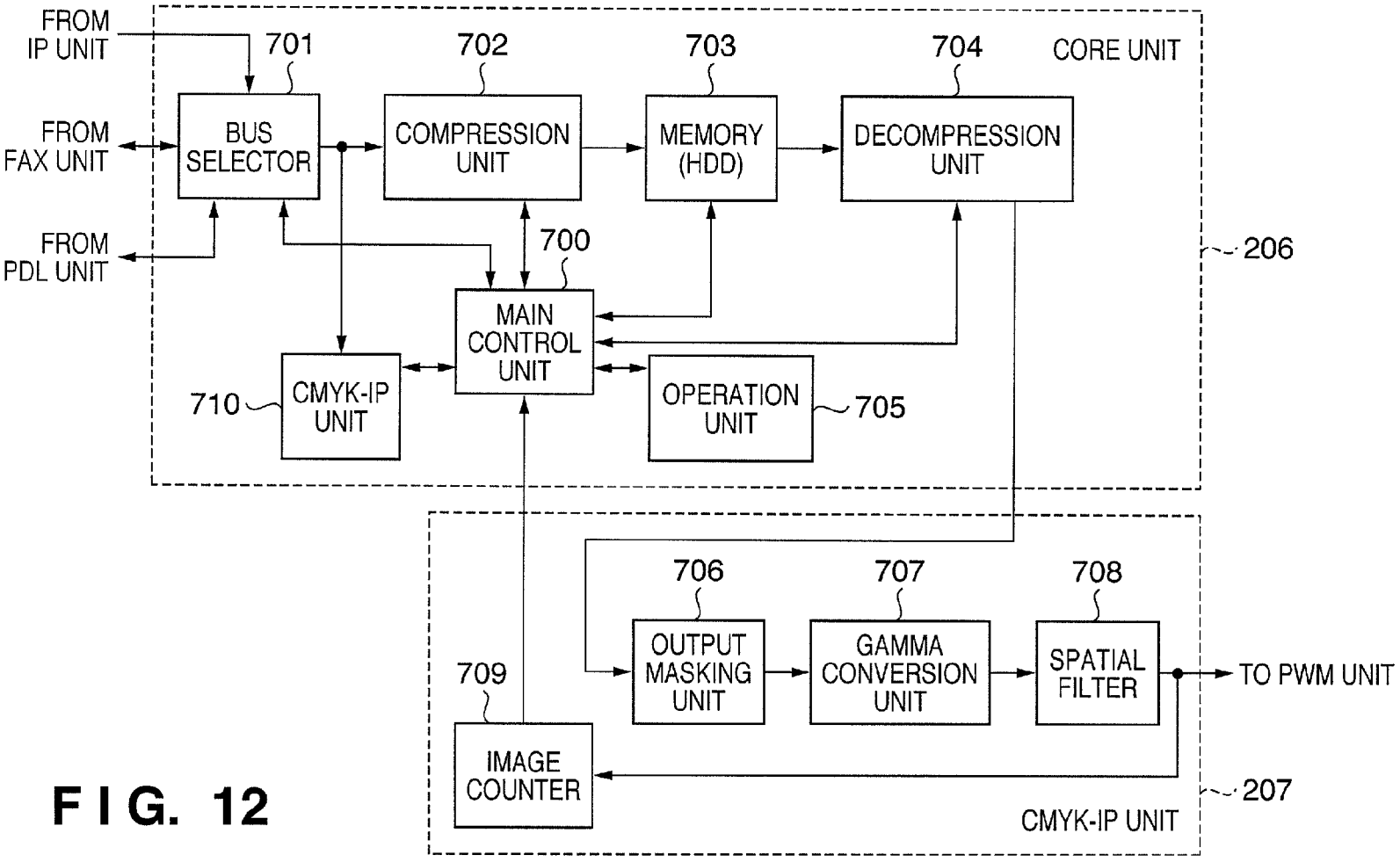
FIG. 12 is a block diagram for explaining details of a core unit in FIG. 2.

[Arrangement of Core Unit: FIG. 12]

The core unit 206 will now be described with reference to FIG. 12.

The main control unit 700 of the core unit 206 controls all modules. A bus selector 701 performs so-called traffic control. That is, the bus selector 701 switches the bus in accordance with various functions such as a stand-alone copying function, network scanning, network printing, and facsimile transmission/reception.

More specifically, the bus selector 701 switches the functions in the following ways: •stand-alone copying apparatus: scanner unit 201→core unit 206→printer unit 209, •network scanning: scanner unit 201→core unit 206→NIC unit 204, •network printing: NIC unit 204→core unit 206→printer unit 209, •facsimile transmission function: scanner unit 201→core unit 206→FAX unit 203, and •facsimile reception function: FAX unit 203→core unit 206→printer unit 209.

Image data output from the bus selector 701 is sent to the printer unit 209 via a compression unit 702, a memory 703 formed from a large-capacity memory such as a hard disk (HDD), and a decompression unit 704.

A CMYK-IP unit 710 has the same functions as those of the CMYK-IP unit 207 to be described later. The CMYK-IP unit 710 determines the image forming stations 10*a*, 10*b*, 10*c*, and 10*d* used for Y, M, C, and K for each page or line on the basis of image data of each page output from the bus selector 701. The CMYK-IP unit 710 also has a function of measuring the time during which each of the image forming stations 10*a*, 10*b*, 10*c*, and 10*d* is not used for image formation. The CMYK-IP unit 710 has a function of measuring Y, M, C, and K toner consumptions. The CMYK-IP unit 710 can store image rate data of each input job before image formation. The compression method used suffices to be a general one such as JPEG, JBIG, or ZIP.

Compressed image data is managed for each job, and stored together with additional data such as a file name, creator, creation date & time, file size, image rate data, and image forming operation mode setting. If a job number and password are also set and stored together with image data, a personal box function can be supported. This is a temporary data storage function, and a confidential function which allows only a specific user to print out (read out data from the HDD). When a stored job is designated and invoked, it is read out from the HDD after password authentication. Then, the image is decompressed into a raster image, which is sent to the printer unit 209. An operation unit 705 allows a user to input an image forming operation, and outputs an operation state.

[Arrangement of CMYK-IP Unit 207: FIG. 12]

The CMYK-IP unit 207 will now be described with reference to FIG. 12.

An output masking/UCR circuit unit 706 receives data transferred from the core unit 206. The output masking/UCR circuit unit 706 uses matrix calculation to convert C1, M1, and Y1 signals LOG-converted (by the LOG converter 405), which has been described with reference to the RGB-IP unit 202, into Y, M, C, and K signals corresponding to the toner colors of the image forming apparatus. The output masking/UCR circuit unit 706 corrects the C1, M1, Y1, and K1 signals based on R, G, and B signals read by the CCD sensor into C, M, Y, and K signals based on the spectral distribution characteristics of toners, outputting the C, M, Y, and K signals.

A gamma conversion unit 707 converts C, M, Y, and K signals into C, M, Y, and K image output data using a lookup table (LUT) RAM in consideration of the color tincture characteristics of the toners. After a spatial filter 708 adds sharpness or performs smoothing, the image signal is sent to the PWM unit 208. An image counter 709 counts the toner consumption from the image signal. The image counter 709 sends the count data to the core unit 206.

Figure 13A:
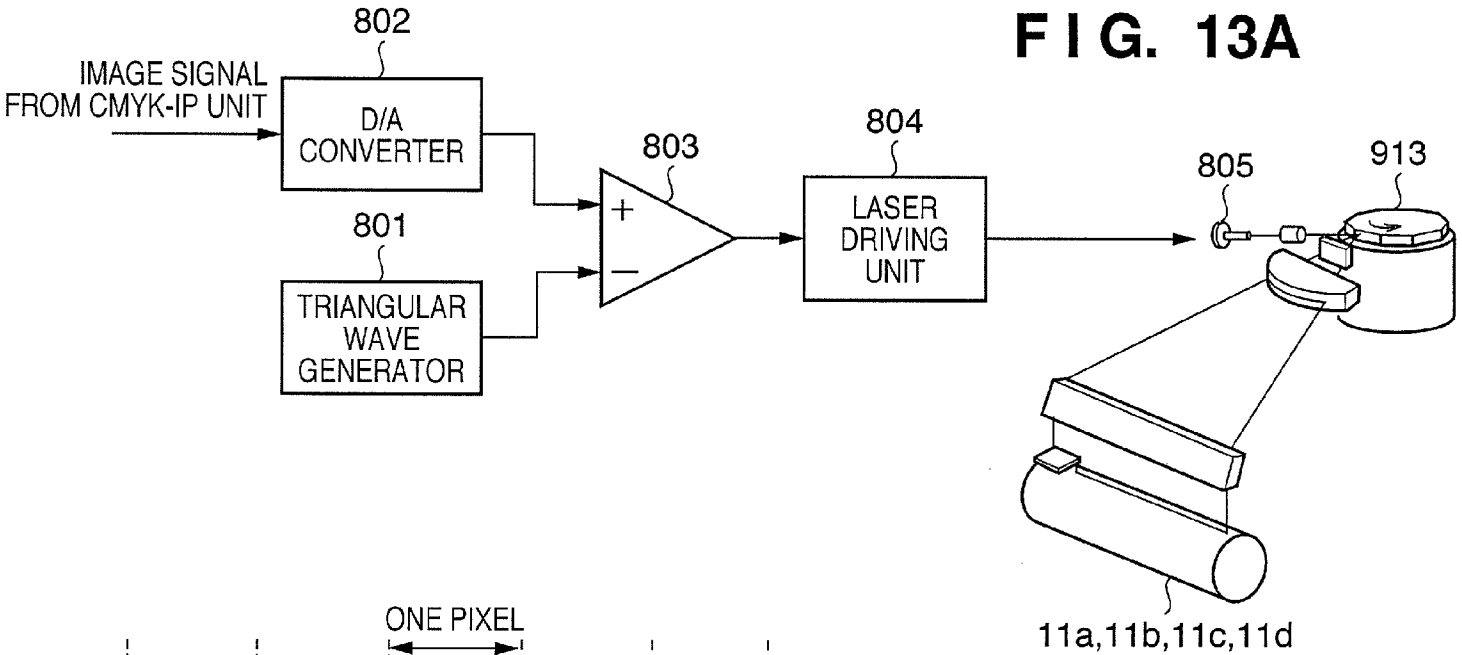
FIGS. 13A and 13B are block diagrams for explaining details of a CMYK-IP unit and PWM unit in FIG. 2.
Figure 13B:
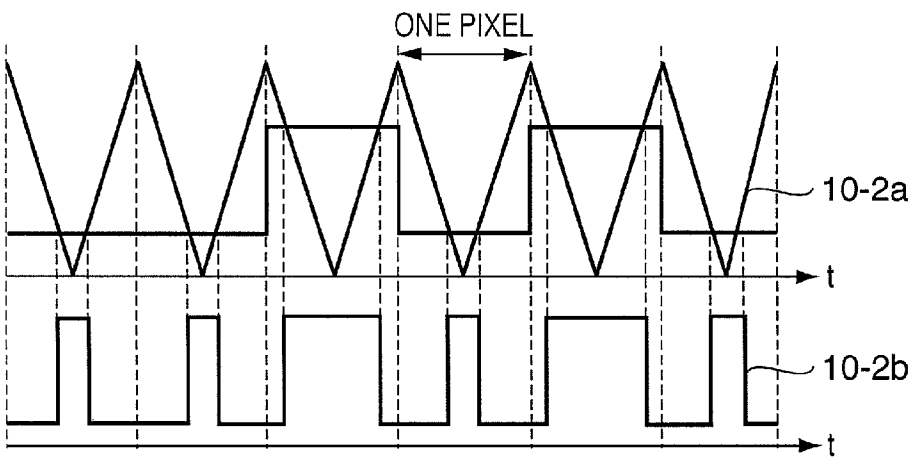

[Arrangement of PWM Unit: FIGS. 13A & 13B]

The PWM unit 208 will now be described with reference to FIG. 13A.

Image data, which is output from the CMYK-IP unit 207 and color separated into the four colors (Y, M, C, and K), passes through the PWM unit 208 to form images. A comparator 803 receives a signal from a triangular wave generator 801, and a signal from a D/A converter 802 which converts an input digital image signal into an analog signal.

As represented by a waveform 10-2*a* in FIG. 13B, these two signals are input to the comparator 803, where their magnitudes are compared. Then, these signals are converted into a signal 10-2*b*, which is sent to a laser driving unit 804. The optical systems 13*a* to 13*d* convert the signal 10-2*b* into laser beams. The laser beams are scanned by a polygon mirror to irradiate the photosensitive drums 11*a*, 11*b*, 11*c*, and 11*d*.

[Paper Feed Operation: FIG. 1]

The paper feed operation will now be explained with reference to FIG. 1.

When the core unit 206 designates the start of the image forming operation, the printer unit 209 feeds paper from a paper feed stage selected in accordance with a selected paper size or the like.

A case where paper is fed from an upper paper feed stage will be described. In FIG. 1, the transfer materials P are fed one by one from the cassette 21*a* by the pickup roller 22*a*. The transfer material P is guided through the paper feed guide 24 by the paper feed roller pairs 23, and conveyed to the registration rollers 25*a* and 25*b*. At this time, the registration rollers 25*a* and 25*b* stop, and the leading end of the transfer material P abuts against the nip between them. Then, the registration rollers 25*a* and 25*b* start rotating in synchronism with the timing when each image forming station starts forming an image. The rotation timing is set such that the transfer material P coincides in the secondary transfer area Te with a toner image primarily transferred from each image forming station onto the intermediate transfer belt 31.

The optical system 13 outputs a laser beam corresponding to an image data signal, and scans it by a polygon mirror in the main scanning direction. The laser beam irradiates the photosensitive drum 11, forming an electrostatic latent image on it. The developing unit 14 develops the electrostatic latent image on the surface of the photosensitive drum 11 by supplying, to the surface of the photosensitive drum 11, toner in an amount corresponding to a potential generated between the surface of the photosensitive drum 11 bearing the electrostatic latent image and the surface of a developing sleeve in the developing bias-applied developing unit 14. The toner image formed on the photosensitive drum 11 is transferred onto the circulating intermediate transfer belt 31.

Through this process, the high voltage-applied primary transfer charger 12*d* primarily transfers, onto the intermediate transfer belt 31 in the primary transfer area Td, a toner image formed on the most-upstream photosensitive drum 11*d*. The primarily transferred toner image is conveyed to the next primary transfer area Tc. In the primary transfer area Tc, an image is formed with a delay time during which a toner image is conveyed between the image forming units. The next toner image is registered and transferred onto the preceding image. The same process is repeated to primarily transfer toner images of the four colors onto the intermediate transfer belt 31.

The transfer material P enters the secondary transfer area Te and comes into contact with the intermediate transfer belt 31. A high voltage is applied to the secondary transfer roller 36 in synchronism with the timing when the transfer material P passes through the secondary transfer area Te. The toner images of the four colors formed on the intermediate transfer belt 31 by the above-described process are transferred onto the surface of the transfer material P. The conveyance guide 43 guides the transfer material P to the nip of the fixing roller. The toner images are fixed onto the surface of the transfer material P by the heat from fixing roller 41*a* and nip pressure. The transfer material P is conveyed by the internal and external delivery rollers 44 and 45, discharged outside the apparatus, and stacked on the delivery tray 48.

[Adjustment Processing during Image Formation]

Adjustment processing which must be performed during image formation of a job by the color image forming apparatus will now be described.

The color image forming apparatus executes a variety of adjustment processes at timings during an image forming job in order to maintain high image quality or maintain the durabilities of various parts which form the apparatus. Adjustment processing is to adjust the image forming parameters because the output image density and density balance of the color image forming apparatus gradually change as the number of output sheets increases or the environment changes. The adjustment processing is executed when a predetermined time has elapsed after previous adjustment processing or the number of images formed after previous adjustment processing exceeds a predetermined value. Image forming parameters are, e.g., the toner supply amount used for image formation and various voltages such as the transfer voltage.

Examples of adjustment processing are patch detection processing to provide a stable toner density necessary to maintain high image quality, ATR (Auto Toner Regulation) processing, and toner discharge processing. Another example is primary transfer ATVC (Auto Transfer Voltage Control) processing to obtain a transfer voltage for achieving optimum transfer. As examples of adjustment processing, patch detection processing, toner discharge processing, and primary transfer ATVC processing will be explained.

[Patch Detection Processing]

In the example of FIG. 1, toner patterns (patches) at a predetermined density are formed on the surfaces of the photosensitive drums 11. Patch detection sensors 62, i.e., 62*a*, 62*b*, 62*c*, and 62*d* read the densities of the toner patterns to compare the read densities with the current optimum target density.

Figure 14:
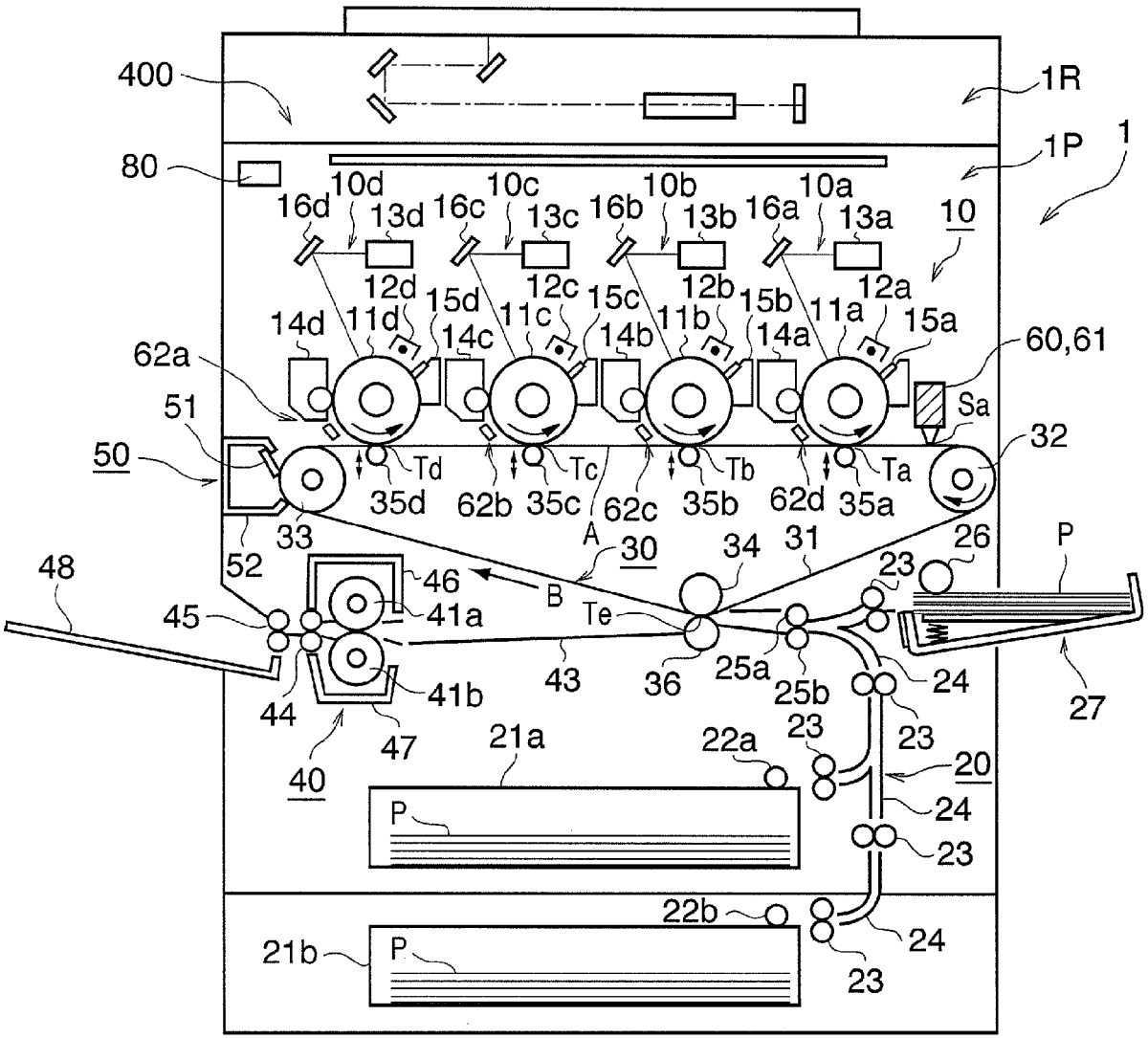
FIG. 14 is a schematic sectional view showing the overall structure of a color image forming apparatus according to another embodiment of the invention.

The optimum target density is determined by the toner supply status and the ratio of toner and carrier. If it is determined that a compared density is higher than the target density upon executing patch detection, toner supply amount adjustment is performed to, e.g., decrease the toner supply amount of a corresponding color in order to decrease the toner density. If it is determined that a compared density is lower than the target density, toner supply amount adjustment is performed to, e.g., increase a corresponding toner supply amount in order to increase the toner density. In toner supply amount adjustment, the difference of a detected patch density from the target density is determined. Based on the determination, the toner supply amount is adjusted. When performing patch detection processing, the primary transfer units 35*a* to 35*d* corresponding to the photosensitive drums 11*a* to 11*d* bearing toner patterns are individually ON/OFF-controlled not to transfer, onto the intermediate transfer belt 31, the toner patterns formed on the photosensitive drums 11*a* to 11*d*. The primary transfer units 35*a* to 35*d* may be of the transfer roller type. In this case, the primary transfer units 35*a* to 35*d* may also be spaced apart from and brought into contact with the intermediate transfer belt 31, as shown in FIG. 14. The primary transfer positions of the photosensitive drums 11*b* and 11*c* near the center in FIG. 14 are set at higher level than those of the photosensitive drums 11*a* and 11*d* apart from the center. The primary transfer positions of the photosensitive drums 11*a* and 11*d* apart from the center are set at higher level than the tops of the rollers 32 and 33. In this structure, when the primary transfer rollers 35*a* to 35*d* in FIG. 14 move apart from the photosensitive drums 11*a* to 11*d*, the intermediate transfer belt 31 also moves apart from them. The primary chargers 12*a* to 12*d*, optical systems 13*a* to 13*d*, developing units (including developing rollers) 14*a* to 14*d*, and cleaning units 15*a* to 15*d* are individually ON/OFF-controlled to remove toner patterns which are necessary for patch detection processing and formed on the photosensitive drums 11*a* to 11*d*. The primary chargers 12*a* to 12*d* may be charging rollers.

Figure 7:
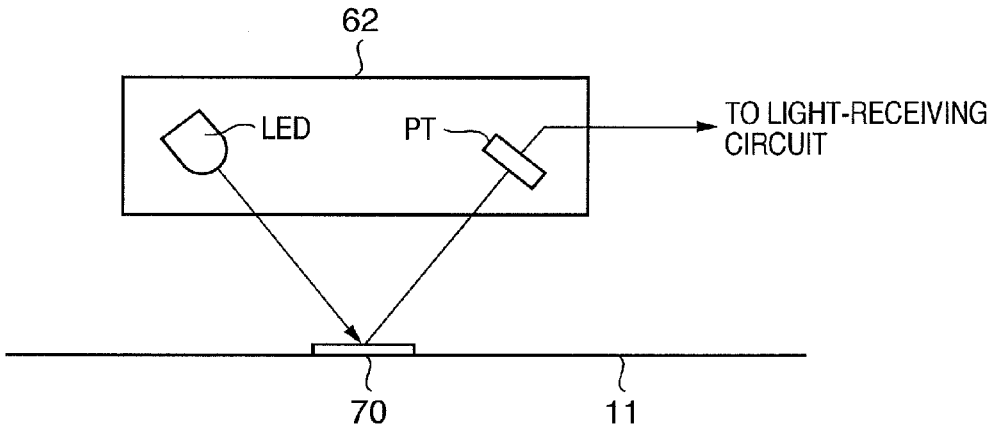
FIG. 7 is a sectional view of the structure of an optical sensor serving as a density correction/detection means.

FIG. 7 shows a state in which photosensors 62 detect a pattern 70 (for correcting the density or detecting image misregistration) on the photosensitive drum 11. The photosensitive drum 11 is formed from a material whose reflectance of light emitted by a light-emitting element (LED) in the photosensor 62 is higher than that of the pattern 70. The difference in reflectance allows detecting the pattern.

Figure 8:
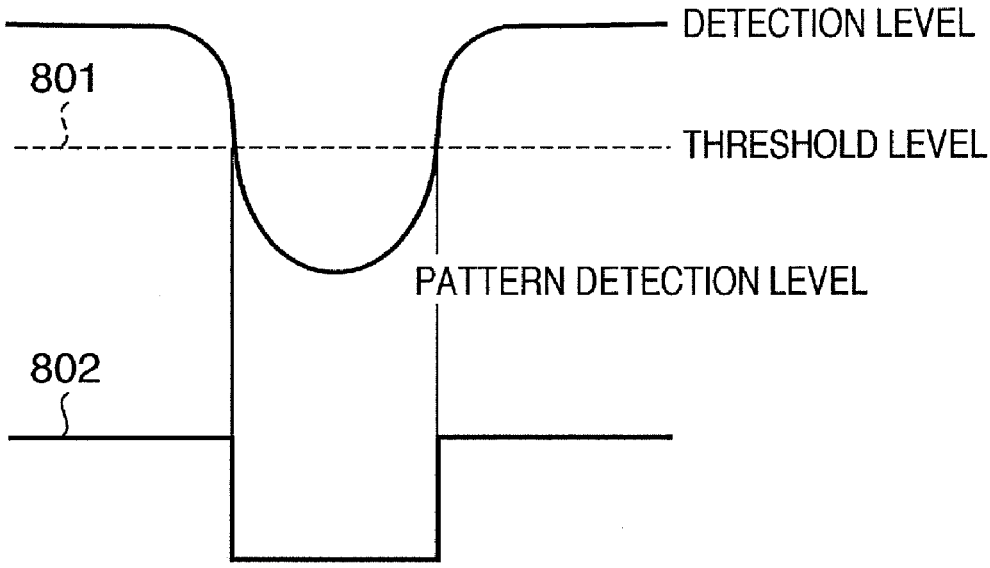
FIG. 8 is a chart showing an output when the density correction/detection toner pattern of a photosensor is read.

FIG. 8 shows a state in which a light-receiving element (phototransistor) PT receives light which is emitted by the LED and reflected by the pattern 70 or photosensitive drum 11. In FIG. 8, reference numeral 801 denotes a state in which the light-receiving circuit detects reflected light in the order of the photosensitive drum 11, pattern 70 and photosensitive drum 11. Reference numeral 802 denotes a waveform obtained by binarizing the waveform 801 at the threshold.

[Toner Discharge Processing]

Another adjustment processing is toner discharge processing. When many images having a low image duty (light images or small-size images) are printed, toner supplied from the toner vessel to the developing position is not completely transferred and remains in the developing unit. Toner accumulates on the charging roller and developing roller. If no image is formed, toner deteriorates gradually. If an image is formed with the deteriorated toner, no image can be satisfactorily reproduced, resulting in poor image quality. Hence, to remove toner remaining on the charging roller and developing roller, the toner is forcibly discharged and removed. Also in this processing, similar to the above-mentioned one, the primary chargers 12*a* to 12*d*, developing units 14*a* to 14*d*, and cleaning units 15*a* to 15*d* corresponding to the photosensitive drums 11*a* to 11*d* requiring toner discharge processing are individually driven.

[Primary Transfer ATVC Processing]

This embodiment executes image formation using the intermediate transfer belt 31 in FIG. 1. A toner image developed on the photosensitive drum 11 is transferred onto the intermediate transfer belt 31 (primary transfer). A transfer voltage set in transfer is influenced by the transferred toner state and the environment where the image forming apparatus is used. To determine a transfer voltage optimum for toner transfer, the relationship between the set transfer voltage and the flowing current is obtained in the use environment to determine a target voltage from the environment and toner state. A voltage attained from the obtained voltage-current relationship is defined as an optimum transfer voltage. The target voltage is determined in advance in a target voltage table based on experimental data. To obtain the relationship between the set transfer voltage and the flowing current, current values at several points are sampled while changing the set voltage. This processing to sample primary transfer current values is called primary transfer ATVC processing. When performing primary transfer ATVC processing, no toner image is formed on the photosensitive drums 11*a* to 11*d*. The primary chargers 12*a* to 12*d*, optical systems 13*a* to 13*d*, and developing units 14*a* to 14*d* corresponding to The photosensitive drums 11*a* to 11*d* subjected to primary transfer ATVC are not individually driven. To the contrary, the primary transfer units 35*a* to 35*d* are individually driven for the photosensitive drums 11*a* to 11*d* subjected to primary transfer ATVC.

<Adjustment Processing During Job-Based Image Formation>

A method of executing adjustment processing while shortening the user's waiting time as much as possible when it is determined that adjustment processing is necessary during an image forming operation to successively form images by the color image forming apparatus on the basis of a job will now be described with reference to FIGS. 3A to 6B.

Figure 3A:
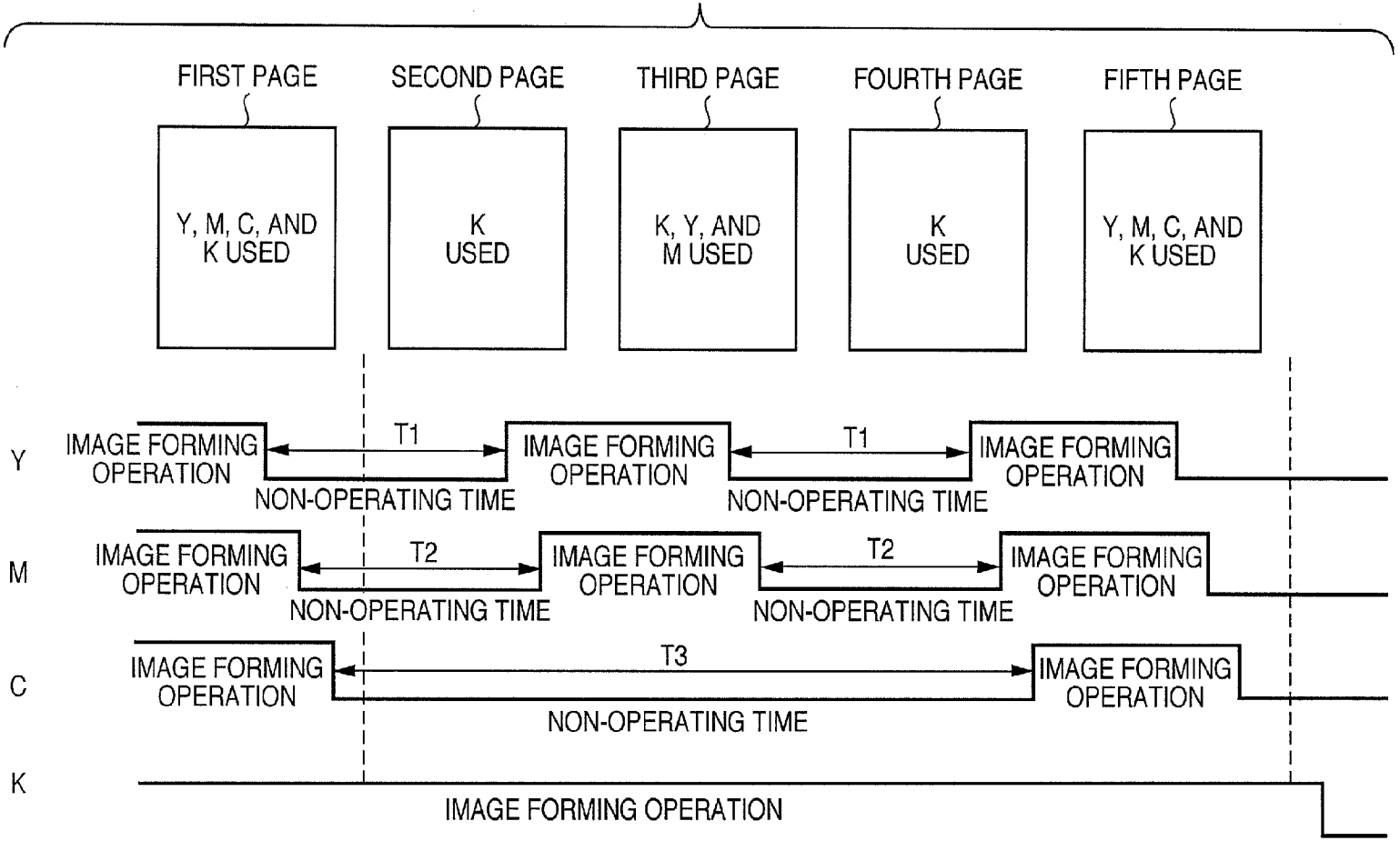
FIG. 3A is a view for explaining the image forming operation time of each image forming station during the image forming operation, and the non-operating time of image formation.

[Example of Job: FIG. 3A]

A case where adjustment processing becomes necessary during image formation by a job shown in FIG. 3A as an example of a job will be exemplified to explain scheduling of adjustment processing in detail.

The job in FIG. 3A is to form images of five pages including full-color and monochrome images. More specifically, the first page has full-color image data using the Y, M, C, and K toners, and the second page has monochrome image data using only the K toner. The third page has image data using the K, Y, and M toners, the fourth page has image data using only the K toner, and the fifth page has full-color image data using the Y, M, C, and K toners.

FIG. 3A also shows the relationship between the image forming operation time during which the Y, M, C, and K image forming stations form job-based images, and the image formation stop time (non-operating time during which no image is formed). For example, in FIG. 3A, the Y image forming station uses Y toner for the first, third, and fifth pages, but does not use it for the second and fourth pages. Hence, the image formation stop time (non-operating time during which no image is formed) is a time period T1 in FIG. 3A from the end of forming the image of the first page to the start of forming the image of the third page, and a time period T1 from the end of forming the image of the third page to the start of forming the image of the fifth page. Similarly, in FIG. 3A, the C image forming station uses C toner for the first and fifth pages, but does not use it for the second to fourth pages. Thus, the image formation stop time period is a time period T3 in FIG. 3A from the end of forming the image of the first page to the start of forming the image of the fifth page.

In the color image forming apparatus, the ROM or RAM in FIG. 2B stores information necessary to calculate the above-described non-operating time of each image forming station. That is, the area 305 of the ROM stores the image forming time of one page and the moving time between images (which may be the time period between conveyed transfer materials) in correspondence with various image sizes (e.g., A4 and B4). The area 309 of the RAM stores color information (see FIG. 3C) used for each image formation. The area 310 stores the result (see FIG. 3D) of extracting a toner not used for each image formation. The area 311 stores the image formation stop time (see FIG. 3E) of each image forming station. Based on these pieces of information, the color image forming apparatus can calculate the non-operating time (e.g., the time T1, T2, or T3 in FIG. 3A) of each image forming station during image formation.

[Method of Calculating Image Formation Stop Time Period (non-operating Time): FIGS. 3B to 3E]

Figure 3B:
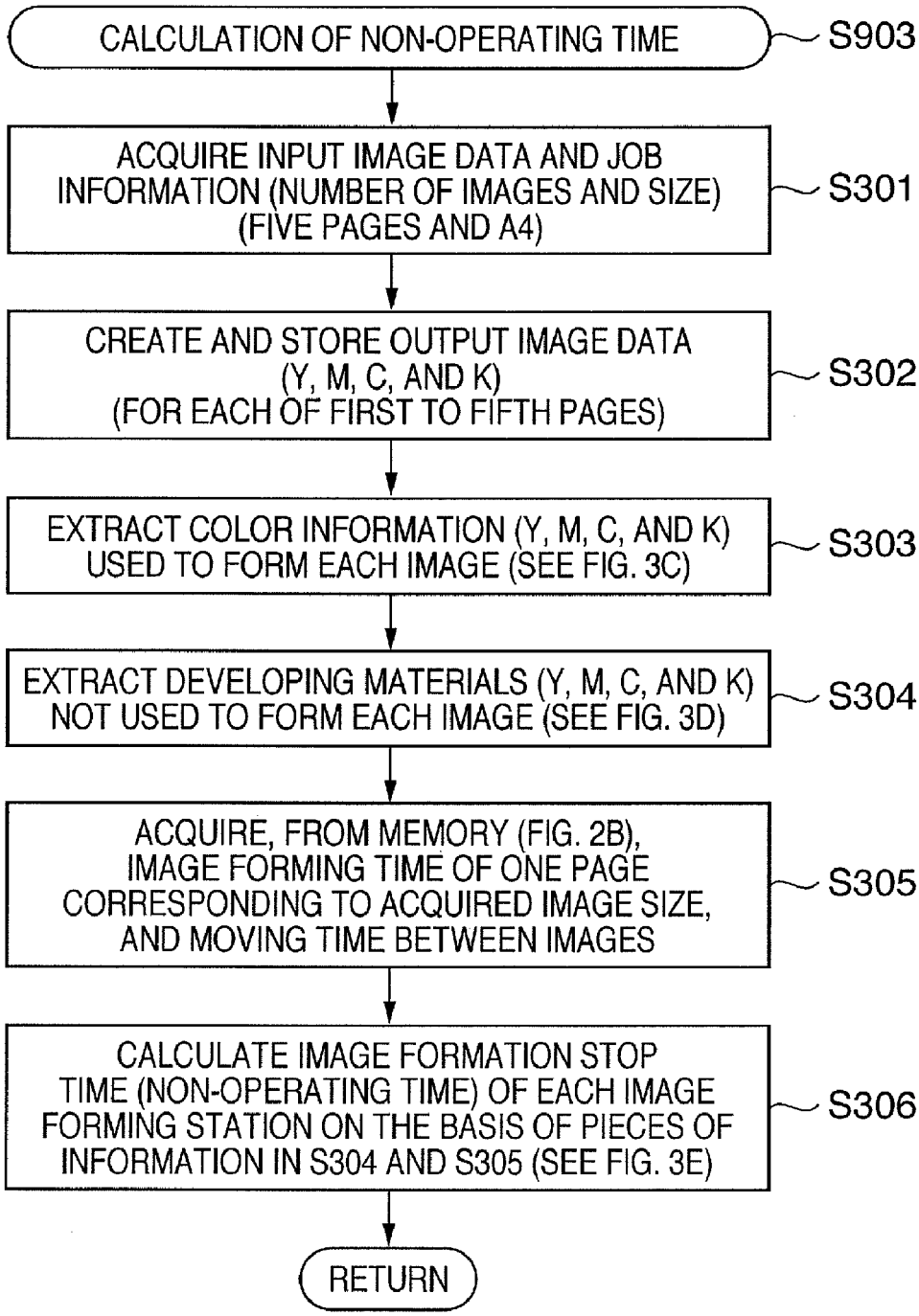
FIG. 3B is a flowchart for explaining an outline of a method of calculating the image formation stop time (non-operating time) of image formation

A method of calculating the image formation stop time period (non-operating time) will be described with reference to FIGS. 3B to 3E. FIG. 3B is a flowchart for explaining an outline of the method of calculating the image formation stop time period (non-operating time) of image formation. FIG. 3B shows a subroutine to execute S903 of FIG. 4 to be described later. FIG. 3C is a table for explaining color information used for image formation. FIG. 3D is a table for explaining the result of extracting a toner not used for each image formation. FIG. 3E is a table for explaining the image formation stop time of each image forming station, the number of stops, the reference page for stop, and the stop time.

An outline of the method of calculating the image formation stop time period of image formation will be described with reference to FIG. 3B by exemplifying the above-mentioned job shown in FIG. 3A.

In step S301, input image data of a job, and job information (input image data type (e.g., RGB, YMC, or page description language), the total number of images, and image size) are acquired. In the job example of FIG. 3A, RGB image data type, five images in total, and A4 image size are acquired.

In step S302, output image data to form an image with the Y, M, C, and K toners is created for each page and stored on the basis of the acquired input image data and job information. In the example of FIG. 3A, YMCK output image data of five pages are created for the respective pages and stored in the RAM.

In step S303, color information used to form an image of each page is extracted from the created output image data of the page. Color information used for image formation as shown in FIG. 3C is created and stored. That is, as for the job in FIG. 3A, Y, M, C, and K for the first page, K for the second page, Y, M, and K for the third page, K for the fourth page, and Y, M, C, and K for the fifth page are extracted as color information used for image formation, and stored in the RAM.

In step S304, a toner not used for each image formation is extracted to create the extraction result shown in FIG. 3D and store it in the RAM. That is, as for the job in FIG. 3A, it is stored that the Y toner is not used for the second and fourth pages. Similarly, it is stored that the M toner is not used for the second and fourth pages. It is stored that the C toner is not used for the second to fourth pages. It is stored that the K toner is used for all the first to fifth pages.

In step S305, the image forming time of one page stored in the ROM, and the time taken to move from the position of a formed image to that of an image to be formed next are acquired.

In step S306, the image formation stop time period (non-operating time) of each image forming station, the number of stops, the reference page for stop, and the stop time shown in FIG. 3E are calculated and stored. The image formation stop time of each image forming station is calculated from the result of extracting a toner not used for each image formation in FIG. 3D, and the image forming time of one page and the moving time which are acquired in step S305. For example, the stop time T1 of the first Y toner step represented by Ty stop (1) 320 in FIG. 3E corresponds to the time T1 from the end of the first page with Y toner to the start of the third page in FIG. 3A. This stop time is calculated as the sum of the image forming time of one page (second page), the moving time between the images of the first and second pages, and the moving time between the images of the second and third pages. This is because Y toner is not used to form the image of the second page, as represented by Y (Yellow) 310 in FIG. 3D. Similarly, the image formation stop times (non-operating times) T1, T2, T2, and T3 represented by Ty stop(2) 321, Tm stop(1) 322, Tm stop(2) 323, and Tc stop(1) 324 are also calculated. However, calculation of the image formation stop time (non-operating time) is not limited to the above-described calculation method.

Figure 4:
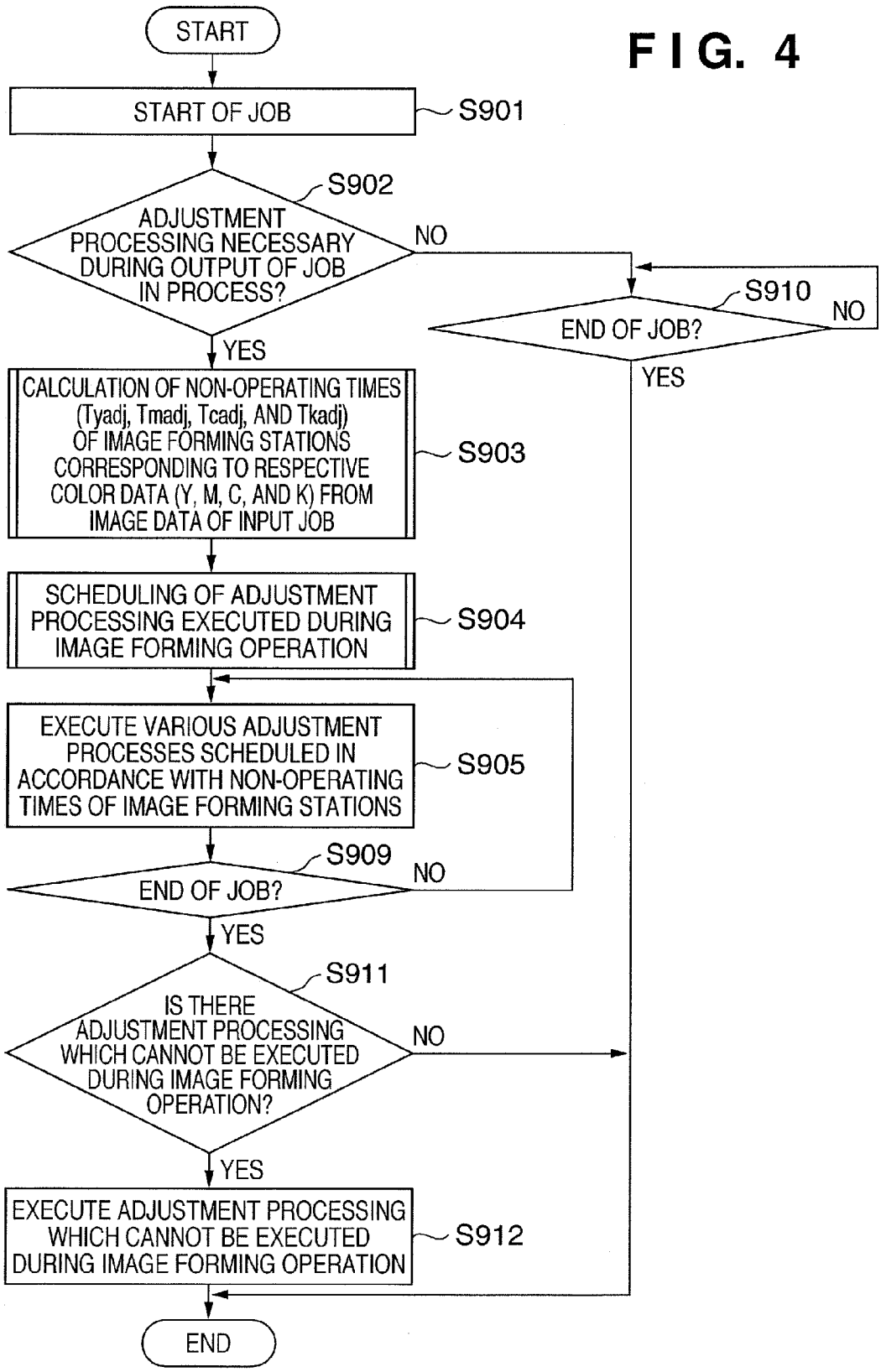
FIG. 4 is a flowchart for explaining scheduling of adjustment processing executed during the image forming operation for each image forming station.

[Scheduling of Adjustment Processing during Image Formation: FIG. 4]

Scheduling of adjustment processing for each image forming station when adjustment processing becomes necessary during job-based image formation using the color image forming apparatus will be explained with reference to FIG. 4.

According to processing in FIG. 4, each image forming station independently executes adjustment processing by using the non-operating time of image formation during the image forming operation. The above-mentioned CPU performs this processing by controlling respective units while using the RAM as a work area on the basis of a control program stored in the ROM. The processing in FIG. 4 will be described concretely with reference to the job example in FIG. 3A.

In step S901, when it is detected that the user has input a job, the job starts.

The process advances to step S902 to determine whether any of the above-described adjustment processes is necessary (whether a condition to perform adjustment processing or toner discharge processing is satisfied) during continuous image output based on a job in process. If it is determined that adjustment processing is necessary, step S903 is executed. Necessary adjustment processing is determined for each image forming station among various adjustment processes associated with image formation described above in consideration of the previous execution timing and the like. In the embodiment, the following adjustment is done when a predetermined time has elapsed after previous adjustment or the number of formed images exceeds a predetermined value.

If it is determined in step S902 that no adjustment is necessary, the process advances to step S910 to continue the image forming operation of the job requiring no adjustment till the end of the image forming job. If the job ends in step S910, a series of work operations ends.

In step S903, the CMYK-IP unit 710 calculates, from input job image data, the non-operating time of image formation of each image forming station 10 corresponding to each color data (Y, M, C, or K) (see FIG. 3B for details). The job in FIG. 3A will be exemplified as an input job. That is, the first page of the job has full-color image data of Y, M, C, and K, the second page has image data of only K, the third page has image data of three, K, Y, and M, the fourth page has image data of only K, and the fifth page has full-color image data of Y, M, C, and K.

In the example of FIG. 3A, since the first page has full-color image data of Y, M, C, and K, it is determined that the image of the first page is formed using all the image forming stations. Since the second page has image data of only K, it is determined that the image of the second page is formed using only the K image forming station. Similarly, it is determined that the image of the third page is formed using only the three, K, Y, and M image forming stations, that of the fourth page is formed using only the K image forming station, and that of the fifth page is formed using all the image forming stations. Further, it is determined that the Y image forming station 10*d* does not form any image during the time T1 from the end of forming the image of the first page to the start of forming the image of the third page.

The non-operating time Ty stop of image formation by the Y image forming station 10*d* is stored as Ty stop(1)=(1,T1) in the RAM, as shown in FIG. 3E. That is, the non-operating time Ty stop of image formation is stored as an array of stops during job processing in the RAM. The stored data (1,T1) means (reference page number for stop, non-operating time of image formation).

As for the second stop, it is determined that the Y image forming station 10*d* does not form any image during the time T1 after the end of forming the image of the third page, and Ty stop(2)=(3,T1). In addition, "2" is stored as the number of stops of image formation by the Y image forming station 10*d*.

It is determined that the M image forming station 10*c* does not form any image during the time T2 after the end of forming the image of the first page. The non-operating time Tm stop(1) of image formation by the M image forming station 10*c* is (1,T2). Similarly, it is determined that the M image forming station 10*c* does not form any image during the time T2 after the end of forming the image of the third page. The non-operating time Tm stop(2) is (3,T2). Also, "2" is stored as the number of stops of image formation by the M image forming station 10*c*.

It is determined that the C image forming station 10*b* does not form any image during the time T3 after the end of forming the image of the first page. The non-operating time Tc stop(1) of image formation by the C image forming station 10*b* is (1,T3). Also, "1" is stored as the number of stops of image formation by the C image forming station 10*b*.

Since the K image forming station 10*a* keeps forming images without stopping during the job, "0" is stored as the number of stops of image formation by the image forming station 10*a*.

After that, the process advances to step S904 to schedule adjustment processing during the job in progress. As adjustment processing to be scheduled during the job, one or a plurality of types of necessary adjustment processes are selected from the above-mentioned image formation adjustment processes for each image forming unit in consideration of the previous execution timing and the like. The total adjustment processing time of the selected adjustment processes is calculated for each image forming station.

For example, Tyadj represents the total adjustment processing time calculated for the Y image forming station 10*d*, and Tmadj represents the total adjustment processing time calculated for the M image forming station 10*c*. Similarly, Tcadj represents the total adjustment processing time calculated for the C image forming station 10*b*, and Tkadj represents that calculated for the K image forming station 10*a*.

The total adjustment processing time is compared with the non-operating time Tstop (count, time) of image formation for each image forming station. The selected adjustment processes are scheduled to fall within the non-operating time of image formation by each image forming station during the job. In this case, a plurality of adjustment processes can be successively performed within the non-operating time of image formation. If the total adjustment processing time is longer than the non-operating time Tstop of image formation, each adjustment processing time is compared with the non-operating time Tstop (count, time) of image formation. The selected adjustment processes are scheduled to fall within the non-operating time of image formation by each image forming station during the job. In this case, each adjustment processing can be done within the non-operating time of image formation.

In step S905, the scheduled adjustment processes are executed. The process advances to step S909 to continue the image forming operation till the end of the image forming job after the adjustment processes are executed at necessary timings. Then, the process advances to step S911.

In step S911, it is determined whether any adjustment processing cannot be executed during the image forming operation. If any adjustment processing cannot be executed during the image forming operation, the process advances to step S912 to execute the adjustment processing and end a series of work operations. If it is determined in step S911 that all the adjustment processes can be executed during the image forming operation, a series of work operations ends.

The processing when adjustment processing becomes necessary during image formation by the image forming apparatus has been described. By using the non-operating time, adjustment processing can be executed for an image forming means determined to have a sufficient non-operating time during which no image is formed during the image forming operation.

Figure 5A:
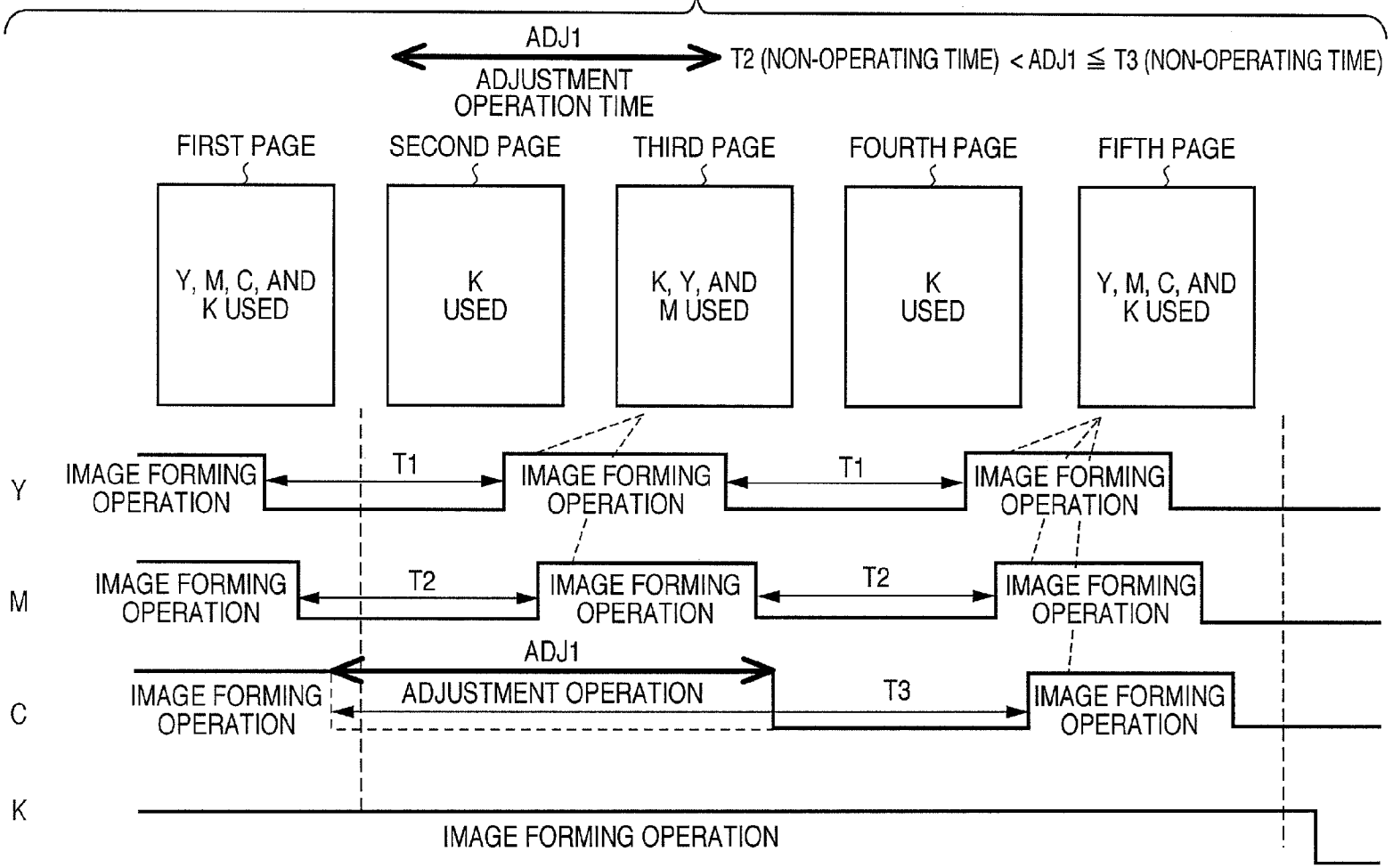
FIG. 5A is a view showing an example of scheduling of (one) adjustment processing executable during the non-operating time of image formation during the image forming operation.

[Case Where Density Adjustment (Patch Detection Processing) Is Necessary for M and C: FIGS. 5A and 5B]

The processes in steps S903 to S905 described above, i.e., scheduling and execution of adjustment processing will be described in detail.

A case where density adjustment (patch detection processing) for an adjustment processing time ADJ1 is necessary for M and C will be explained. Assume that adjustment processing for M and C is density adjustment (patch detection processing), and the adjustment processing time ADJ1 for M and C is T2<ADJ1≦T3.

FIG. 5A is a view showing a scheduling result of (one) adjustment processing executable during the non-operating time of image formation during the image forming operation. FIG. 5B is a table showing an example of storing the scheduling result of adjustment processing in FIG. 5A in the RAM.

In the following description, assume that an input job has image data shown FIG. 5A.

More specifically, the first page has full-color image data of Y, M, C, and K, the second page has image data of only K, the third page has image data of three, K, Y, and M, the fourth page has image data of only K, and the fifth page has full-color image data of Y, M, C, and K.

In this case, in step S903 of FIG. 4, the number of stops of M image formation is two, and non-operating time data of image formation are Tm stop(1)=(1,T2) and Tm stop(2)=(3, T2), as shown in FIG. 3E.

In step S904, the M density adjustment processing time ADJ1 necessary for a job in process is compared with the first non-operating time T2 of image formation to determine whether M density adjustment processing is executable. Since the M density adjustment processing time ADJ1>the first non-operating time T2 of image formation, it is determined that no density adjustment processing is executable at the first stop of M image formation. Then, it is determined whether the second stop of M image formation exists. Since the number of stops of M image formation is two, it is determined that the second stop of M image formation exists.

The M density adjustment processing time ADJ1 necessary for the job in process is compared with the second non-operating time T2 of image formation to determine whether M density adjustment processing is executable. Since the M density adjustment processing time ADJ1>the second non-operating time T2 of image formation, it is determined that no density adjustment processing is executable at the second stop of M image formation.

Similarly in step S903, the number of stops of C image formation is one, and non-operating time data of image formation is Tc stop(1)=(1,T3).

In step S904, the C density adjustment processing time ADJ1 necessary for a job in process is compared with the first non-operating time T3 of image formation to determine whether C density adjustment processing is executable. Since the C density adjustment processing time ADJ1<the first non-operating time T3 of image formation, it is determined that density adjustment processing is executable at the first stop of C image formation. This determination result is shown in FIG. 5B and stored in the RAM.

In step S905, after the C image of the first page is formed, the C image forming station 10*b* moves apart from the intermediate transfer belt 31, and C density adjustment processing is done. Upon the lapse of the non-operating time T3 of image formation after the end of forming the image of the first page, the C image forming station 10*b* comes into contact with the intermediate transfer belt 31 and prepares for the next image forming operation. As for M for which it is determined that no density adjustment processing is executable, the density adjustment processing is performed during post-rotation in step S911 after the end of the job or between jobs.

Figure 6A:
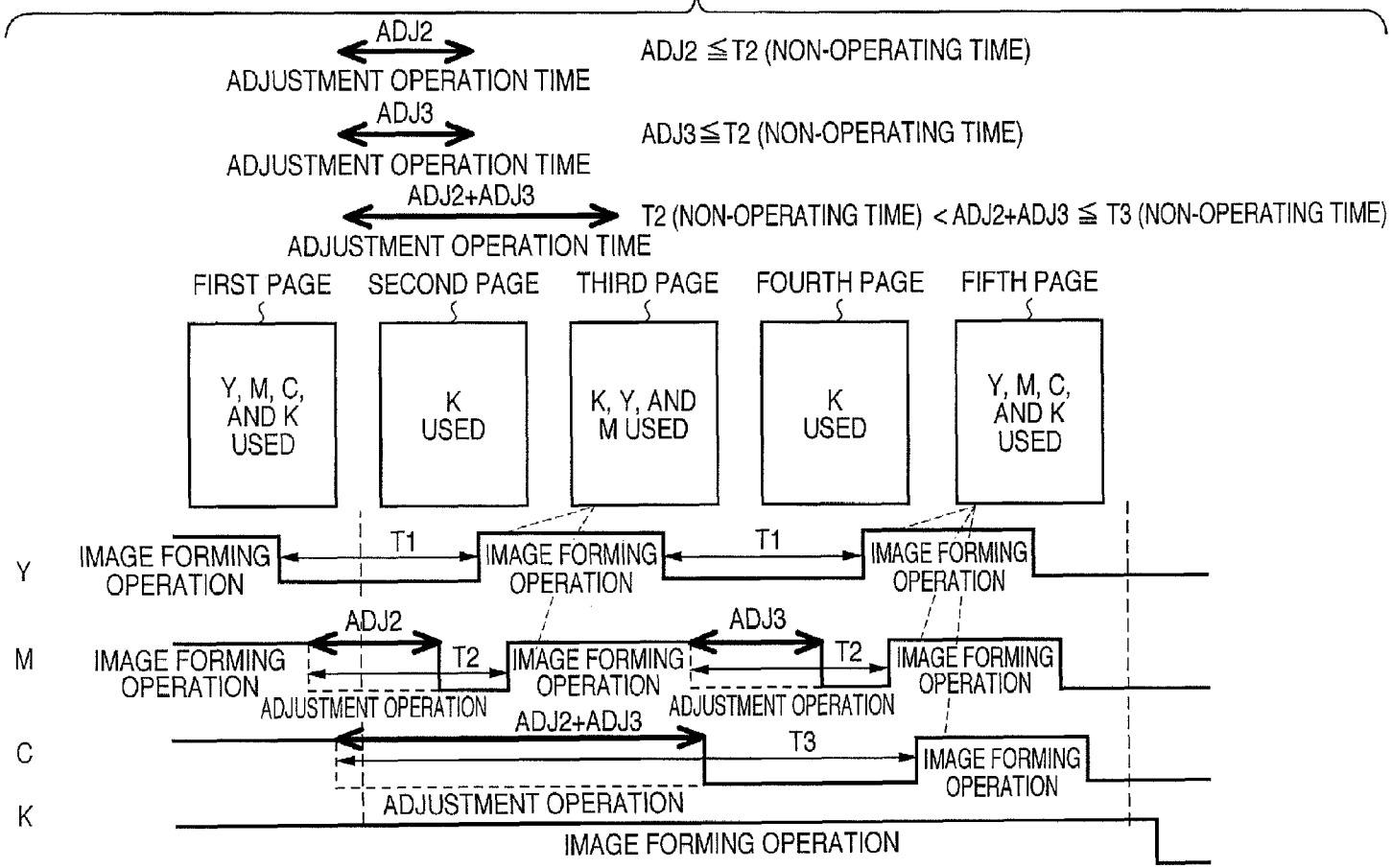
FIG. 6A is a view showing another example of scheduling of (one or two) adjustment processes executable during the non-operating time of image formation during the image forming operation.

[Case Where Density Adjustment and Toner Discharge Adjustment Are Necessary for M and C: FIGS. 6A and 6B]

A case where density adjustment for an adjustment processing time ADJ2 and toner discharge adjustment for an adjustment processing time ADJ3 are necessary for M and C will be explained. Assume that the density adjustment processing time ADJ2 for M and C is ADJ2≦T2, and the toner discharge adjustment processing time ADJ3 for M and C is ADJ2≦T2.

FIG. 6A is a view showing a scheduling result of (one or two) adjustment processes executable during the non-operating time of image formation during the image forming operation. FIG. 6B is a table showing an example of storing the scheduling result of adjustment processes in FIG. 6A in the RAM.

In the following description, assume that an input job has image data shown FIG. 6A.

More specifically, the first page has full-color image data of Y, M, C, and K, the second page has image data of only K, the third page has image data of three, K, Y, and M, the fourth page has image data of only K, and the fifth page has full-color image data of Y, M, C, and K.

In this case, in step S903, the number of stops of M image formation is two, and non-operating time data of image formation are Tm stop(1)=(1,T2) and Tm stop(2)=(3,T2), as shown in FIG. 3E.

In step S904, the sum of the M density adjustment processing time ADJ2 and toner discharge adjustment time ADJ3 necessary for a job in process is compared with the first non-operating time T2 of image formation to determine whether M density adjustment processing is executable. Since the M density adjustment processing time ADJ2+ADJ3>the first non-operating time T2 of image formation, it is determined that neither density adjustment processing nor toner discharge adjustment is executable at the first stop of M image formation.

Then, the M density adjustment processing time ADJ2 necessary for the job in process is compared with the first non-operating time T2 of image formation to determine whether M density adjustment processing is executable. Since the M density adjustment processing time ADJ2<the first non-operating time T2 of image formation, it is determined that density adjustment processing is executable at the first stop of M image formation. After that, it is determined whether the second stop of M image formation exists. Since the number of stops of M image formation is two, it is determined that the second M stop of image formation exists.

The M toner discharge adjustment processing time ADJ3 necessary for the job in process is compared with the second non-operating time T2 of image formation to determine whether M toner discharge adjustment processing is executable. Since the M toner discharge adjustment time ADJ3<the second non-operating time T2 of image formation, it is determined that toner discharge adjustment is executable at the second stop of M image formation. This determination result is shown in FIG. 6B and stored in the RAM.

In step S905, after the M image of the first page is formed, the M image forming station 10*c* moves apart from the intermediate transfer belt 31, and M density adjustment processing is done. Upon the lapse of the non-operating time T2 of image formation after the end of forming the image of the first page, the M image forming station 10*c* comes into contact with the intermediate transfer belt 31 and prepares for the next image forming operation. Also, after the M image of the third page is formed, the. M image forming station 10*c* moves apart from the intermediate transfer belt 31, and toner discharge adjustment is done. Upon the lapse of the non-operating time T2 of image formation after the end of forming the image of the third page, the M image forming station 10*c* comes into contact with the intermediate transfer belt 31 and prepares for the next image forming operation.

Similarly in step S03, the number of stops of C image formation is one, and non-operating time data of image formation is Tc stop(1)=(1,T3), as shown in FIG. 3E.

In step S904, the sum of the C density adjustment processing time ADJ2 and toner discharge adjustment time ADJ3 necessary for the job in process is compared with the first non-operating time T3 of image formation to determine whether C density adjustment processing is executable. Since the C density adjustment processing time ADJ2+ADJ3<the first non-operating time T3 of image formation, it is determined that density adjustment processing and toner discharge adjustment are executable at once at the first stop of C image formation.

In step S905, after the C image of the first page is formed, the C image forming station 10*b* moves apart from the intermediate transfer belt 31, and C density adjustment processing and toner discharge adjustment are done at once. Upon the lapse of the non-operating time T3 of image formation after the end of forming the image of the first page, the C image forming station 10*b* comes into contact with the intermediate transfer belt 31 and prepares for the next image forming operation.

In the above-described example, image adjustment processing of an image forming station can be performed using the non-operating time of the image forming station during which the image forming station is not used for image formation during the image forming operation. Consequently, the image forming apparatus can shorten the down time of image adjustment processing as much as possible and enhance usability.

Other Embodiments

The embodiment has described a system in which an image on the photosensitive drum is formed onto a transfer material via the intermediate transfer belt. However, the present invention is also applicable to a system in which an image on the photosensitive drum is directly formed onto a transfer material.

The object of the present invention is also achieved by supplying a storage medium which stores software program codes for implementing the functions of the above-described embodiment to a system or apparatus. In this case, the computer (or the CPU or MPU) of the system or apparatus reads out and executes the program codes stored in the storage medium.

In this case, the program codes read out from the storage medium implement the functions of the above-described embodiment, and the program codes and the storage medium which stores the program codes constitute the present invention.

The storage medium for supplying the program codes includes a floppy® disk, hard disk, magnetooptical disk, CD-ROM, CD-R, and CD-RW. The storage medium also includes a DVD-ROM, DVD-RAM, DVD–RW, DVD+RW, magnetic tape, nonvolatile memory card, and ROM. The program codes may also be downloaded via a network.

The functions of the above-described embodiment are implemented by executing the readout program codes by the computer. Also, the present invention includes a case where an OS (Operating System) or the like running on the computer performs some or all of actual processes on the basis of the instructions of the program codes and thereby implements the functions of the above-described embodiments.

Furthermore, the present invention includes a case where the functions of the above-described embodiments are implemented as follows. That is, the program codes read out from the storage medium are written in the memory of a function expansion board inserted into the computer or the memory of a function expansion unit connected to the computer. After that, the CPU of the function expansion board or function expansion unit performs some or all of actual processes on the basis of the instructions of the program codes.

In this case, the program is supplied directly from the storage medium which stores the program, or downloaded from another computer, database, or the like (not shown) connected to the Internet, a commercial network, a local area network, or the like.

The embodiment has exemplified an electrophotographic image forming apparatus. However, the present invention is not limited to electrophotographic printing, and can also be applied to a variety of image forming methods such as inkjet printing, thermal transfer printing, thermal printing, electrostatic printing, and electrosensitive printing.

The program may take the form of an object code, a program code executed by an interpreter, script data supplied to the OS (Operating System), or the like.

The present invention can provide an image forming apparatus capable of shortening the user's print waiting time as much as possible when it is determined that image adjustment is necessary during the image forming operation, and a control method therefor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-261416 filed on Sep. 26, 2006, which is hereby incorporated by reference herein in its entirety.

What is claimed is

1. An image forming apparatus including a plurality of image forming stations which form toner images on a page on the basis of a job for forming an image, the apparatus comprising:

a discrimination unit adapted to discriminate whether a condition to perform adjustment processing for parameters of the plurality of image forming stations during an image forming operation of a plurality of pages based on the job is satisfied;

a determination unit adapted to, in a case where said discrimination unit discriminates that the condition to perform adjustment processing is satisfied, determine whether at least one of the plurality of image forming stations has a non-operating time period long enough to execute adjustment processing satisfying the condition during the image forming operation of the plurality of pages; and a control unit adapted to perform the adjustment processing to the at least one of the plurality of image forming stations having the non-operating time period long enough during the non-operating time period, wherein said determination unit determines the non-operating time period of each of the plurality of image forming stations during the image forming operation of the plurality of pages, and wherein said determination unit determines a continuous non-operating time period of an image forming station among the plurality of image forming stations that does not form an image during image forming operations of the remaining image forming stations.

2. The apparatus according to claim 1, wherein said determination unit determines for each page (i) an image forming station among the plurality of image forming stations which forms an image and (ii) an image forming station among the plurality of image forming stations which does not form an image, and determines the continuous non-operating time period of the image forming station among the plurality of image forming stations which does not form an image.

3. An image forming apparatus including a plurality of image forming stations which form toner images on a page on the basis of a job for forming an image, the apparatus comprising:

a discrimination unit adapted to discriminate whether a condition to perform adjustment processing for parameters of the plurality of image forming stations during an image forming operation of a plurality of pages based on the job is satisfied;

a determination unit adapted to, in a case where said discrimination unit discriminates that the condition to perform adjustment processing is satisfied, determine whether at least one of the plurality of image forming stations has a non-operating time period long enough to execute adjustment processing satisfying the condition during the image forming operation of the plurality of pages; and a control unit adapted to perform the adjustment processing to the at least one of the image forming stations having the non-operating time period long enough during the non-operating time period, wherein when said discrimination unit discriminates that the condition to perform a plurality of adjustment processes is satisfied during the image forming operation, and said determination unit determines that an image forming station among the plurality of image forming stations has a non-operating time period not shorter than a total time period necessary for executing the plurality of adjustment processes, said control unit executes the plurality of adjustment processes for the image forming station having the non-operating time period not shorter than the total time period necessary for executing the plurality of adjustment processes, and when said discrimination unit discriminates that a plurality of adjustment processes must be performed during the image forming operation, and said determination unit determines that an image forming station among the plurality of image forming stations has a non-operating time period shorter than the total time period necessary for executing the plurality of adjustment processes, said control unit separately executes the plurality of adjustment processes for the image forming station having the non-operating time period shorter than the total time period necessary for executing the plurality of adjustment processes.

4. An image forming apparatus including a plurality of image forming stations which form toner images on a page on the basis of a job for forming an image, the apparatus comprising:

a discrimination unit adapted to discriminate whether a condition to perform adjustment processing for parameters of the plurality of image forming stations during an image forming operation of a plurality of pages based on the job is satisfied;

a determination unit adapted to, in a case where said discrimination unit discriminates that the condition to perform adjustment processing is satisfied, determine whether at least one of the plurality of image forming stations has a non-operating time period long enough to execute adjustment processing satisfying the condition during the image forming operation of the plurality of pages; and a control unit adapted to perform the adjustment processing to the at least one of the plurality of image forming stations having the non-operating time period long enough during the non-operating time period, wherein said discrimination unit discriminates, on the basis of an elapsed time period after executing a previous adjustment processing or on the basis of a number of image-formed pages after previous adjustment processing, whether the condition to execute adjustment processing is satisfied, wherein the plurality of image forming stations have image carriers which carry toner images, and sensors which read toner patterns on the image carriers, wherein the adjustment processing includes an operation to form a toner pattern on each of the image carriers at a predetermined density and to read the toner pattern on each of the image carriers by a respective sensor in order to adjust a parameter of each of the plurality of image forming stations, and wherein the parameter includes one of a toner supply amount and a transfer voltage for each of the plurality of image forming stations.

* * * * *